US009868291B2

(12) United States Patent
Hayashi

(10) Patent No.: US 9,868,291 B2
(45) Date of Patent: Jan. 16, 2018

(54) TANK

(71) Applicant: BROTHER KOGYO KABUSHIKI KAISHA, Nagoya-shi, Aichi-ken (JP)

(72) Inventor: Masahiro Hayashi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/082,453

(22) Filed: Mar. 28, 2016

(65) Prior Publication Data

US 2017/0087857 A1 Mar. 30, 2017

(30) Foreign Application Priority Data

Sep. 30, 2015 (JP) ..... 2015-193591

(51) Int. Cl.
*B41J 2/175* (2006.01)
*B41J 29/13* (2006.01)

(52) U.S. Cl.
CPC ..... *B41J 2/17523* (2013.01); *B41J 2/1752* (2013.01); *B41J 2/17509* (2013.01); *B41J 2/17513* (2013.01); *B41J 2/17536* (2013.01); *B41J 2/17553* (2013.01); *B41J 29/13* (2013.01)

(58) Field of Classification Search
CPC .... B41J 2/17523; B41J 2/1754; B41J 2/1752; B41J 2/17506
See application file for complete search history.

(56) References Cited

U.S. PATENT DOCUMENTS

2005/0011916 A1* 1/2005 Battista ..... B41J 2/17509 222/576
2005/0110849 A1 5/2005 Mui et al.
2005/0174408 A1 8/2005 Qingguo et al.
2014/0043408 A1 2/2014 Kudo et al.

FOREIGN PATENT DOCUMENTS

CN 2691854 Y 4/2005
JP 2005-199693 A 7/2005
JP 2014-037058 A 2/2014

* cited by examiner

*Primary Examiner* — Geoffrey Mruk
(74) *Attorney, Agent, or Firm* — Merchant & Gould P.C.

(57) ABSTRACT

There is provided a tank including: a liquid storage chamber; an outer wall having an inner surface and an outer surface; a cylindrical wall; an inlet port; an outlet port; and a cap for the inlet port. The cap has a seal portion configured to contact an inner circumferential surface of the cylindrical wall or of the outer wall defining the inlet port, or contact an end surface of the cylindrical wall exposed to the outside of the tank, in a state that the cap is installed in the inlet port; and a plurality of stoppers each of which has an abutting surface configured to contact the tank toward the first direction under a condition that the cap is being moved toward the first direction from the state of being installed in the inlet port.

15 Claims, 17 Drawing Sheets

TANK

CROSS REFERENCE TO RELATED APPLICATION

The present application claims priority from Japanese Patent Application No. 2015-193591 filed on Sep. 30, 2015, the disclosure of which is incorporated herein by reference in its entirety.

BACKGROUND

Field of the Invention

The present invention relates to a tank configured to supply a liquid to a liquid consuming section of, for example, a liquid consuming apparatus such as an ink-jet printer, etc.

Description of the Related Art

Conventionally, there is known a liquid consuming apparatus such as an ink-jet printer which is provided with a liquid storage chamber configured to store a liquid and a liquid consuming section configured to consume the liquid stored in the liquid storage chamber. For example, conventionally, there is known an ink-jet printer provided with an ink tank storing an ink, and a liquid discharging (jetting) head configured to discharge the ink supplied from the ink tank to the liquid discharging head via a liquid lead-out port. This conventionally known ink tank can be replenished with the ink from an inlet port provided on the ink tank. The inlet port can be opened/closed by attaching/detaching a cap with respect to the inlet port. By opening/closing the inlet port, it is possible to prevent any outflow of the ink stored in the ink tank from the inlet port. This cap seals the inlet port in a liquid-tight (fluid-tight) manner by making a tight contact with the inner surface of a cylindrical wall defining the inlet port, at the outer circumference surface of the cap.

Further, conventionally, there is known a container for continuously supplying an ink. This container for continuously supplying the ink is configured to supply an ink to a print head, an ink cartridge, etc. of an ink-jet printer, and the like. A cap capable of sealing an inlet port of the container for continuously supplying the ink has a handle portion having a cylindrical shape, and an umbrella portion provided on an end portion of the handle portion and having the outer diameter greater than that of the handle portion. In a state that the cap is installed in the inlet port, the handle portion is located inside the cylindrical wall of the inlet port, and a surface, in the umbrella portion, facing the handle portion makes tight contact with the inner wall of the tank, whereby the cap seals the inlet port in the liquid-tight manner.

SUMMARY

In a case that the cap is attached to or removed from the inlet port in the above-described liquid consuming apparatus, the friction force acts between the cap and the inner surface of the cylindrical wall defining the inlet port. Under a condition that this frictional force is set to be relatively small, the cap can be easily attached/detached with respect to the inlet port. On the other hand, however, under a condition that the frictional force is small, there is such a fear that, when for example the inner pressure in the tank becomes greater than the atmospheric pressure, or when the ink-jet printer is turned upside down in the up-down direction and the weight of the ink inside the tank is applied to the cap, the cap installed in the inlet port might be inadvertently or unintentionally detached or come off from the inlet port.

In the above-described container for continuously supplying the ink, the cap is fixed to the inlet port by the tight contact of the umbrella portion of the cap to the inner surface of a portion, the tank, located in the surrounding of the inlet port. When the cap is attached/detached with respect to the inlet port, the cap is required to slidably move on the inner surface of the inlet port while allowing the umbrella portion of the cap to elastically deform. Accordingly, the force required for attaching/detaching the cap with respect to the inlet port becomes great as compared with the force required, for example, for attaching/detaching the cap with respect to the inlet port in the above-described liquid consuming apparatus. Further, there is also such a fear that, when the cap is removed from the inlet port, the umbrella portion which has been elastically deformed inside the inlet port is pulled out from the inlet port and restored to the original shape of the umbrella portion, and thereby might allow any ink adhered to the umbrella portion to scatter. On the other hand, in a case that the inner pressure of the tank is greater than the atmospheric pressure, or in a case that the ink-jet printer is turned upside down in the up-down direction, the possibility that the cap might be detached from the inlet port is small.

The present teaching has been made in view of the above-described situations, and an object of the present teaching is to provide a tank capable of achieving at least one of the followings: capability of easily attaching/detaching the cap with respect to the inlet port of the tank; capability of suppressing any scattering of a liquid such as an ink when the cap is removed from the inlet port; and capability of suppressing any inadvertent detaching of the cap from the inlet port.

According to a first aspect of the present teaching, there is provided a tank configured to store a liquid to be supplied to a liquid discharging section configured to discharge the liquid, the tank including:

a liquid storage chamber configured to store the liquid;

an outer wall having an inner surface facing the liquid storage chamber and an outer surface facing outside of the tank;

a cylindrical wall having a cylindrical shape and extending from the outer wall in a first direction;

an inlet port penetrating through the outer wall and the cylindrical wall in the first direction, and communicating the liquid storage chamber with the outside of the tank;

an outlet port penetrating through the outer wall and communicating the liquid storage chamber with the outside of the tank; and a cap configured to be detachably installable in the inlet port, the cap having:

- a seal portion configured to contact an inner circumferential surface of the cylindrical wall or of the outer wall defining the inlet port, or contact an end surface of the cylindrical wall exposed to the outside of the tank, in a state that the cap is installed in the inlet port; and
- a plurality of stoppers provided on the cap while being spaced from each other in a circumferential direction, of the cap, of which center is the first direction in the state that the cap is installed in the inlet port, each of the plurality of stoppers having an abutting surface configured to contact the tank toward the first direction under a condition that the cap is being moved toward the first direction from the state of being installed in the inlet port.

According to the above-described configuration, the cap is provided with the seal portion and the plurality of stoppers separately from each other. The seal portion has the function of sealing the inlet port in the liquid-tight manner. The plurality of stoppers have the function of suppressing any detachment of the cap from the inlet port. Even in a case of elastically deforming the cap so as to install the cap in the inlet port in order that the cap is moved up to a position at which the abutting surface of each of the plurality of stoppers can contact the tank toward the first direction, the plurality of stoppers are provided on the cap while being spaced from each other in the circumferential direction of the cap. Accordingly, the cap is elastically deformed with a force smaller than a force in a case that the stoppers are provided on the cap along the entire circumference thereof in the circumferential direction. Thus, a user can install the cap in the inlet port by moving the cap, with a relatively small force, up to the position at which the abutting surface of each of the stoppers can contact the tank in the first direction. Similarly, also in a case of removing the cap from the inlet port by elastically deforming the cap so as to release the contact of the abutting surface with respect to the tank, the plurality of stoppers are provided on the cap while being spaced from each other in the circumferential direction of the cap. Accordingly, the cap is elastically deformed with a force smaller than the force in the case that the stoppers are provided on the cap along the entire circumference thereof in the circumferential direction. Thus, the user can remove the cap from the inlet port by releasing the contact of the abutting surface of each of the stoppers with respect to the tank, with a relatively small force. Further, the plurality of stoppers are provided on the cap while being spaced from each other in the circumferential direction of the cap. Accordingly, by for example rotating the cap about the first direction, the cap can be moved up to the position at which the abutting surface of each of the stoppers can contact with respect to the tank in the first direction, without elastically deforming the cap, thereby making it possible to attach the cap to the inlet port. Similarly, by for example rotating the cap about the first direction, the contact of the abutting surfaces of the respective stoppers with respect to the tank can be released so as to detach the cap from the inlet port, without elastically deforming the cap.

Furthermore, when the cap is being detached from the inlet port, the force by which the cap which has been elastically deformed returns to its original shape is small. Thus, even if any liquid such as an ink is adhered to the cap, it is possible to suppress any scattering of the ink adhered to the cap.

Moreover, since the seal portion and the stoppers are provided independently from each other, the sealing function of the seal portion is not lowered even though the stoppers are not provided along the entire circumference in the circumferential direction of the cap.

Further, in a case that the cap is being moved toward the first direction from the state of being installed in the inlet port, the abutting surface of each of the stoppers contacts the tank, and forces mutually pressing in opposite directions act on the space between the abutting surface of each of the stoppers and the tank. Thus, in a case that the inner pressure in the tank becomes greater than the atmospheric pressure, or in another case that the tank is turned upside down in the up-down direction and the weight of the ink inside the tank is applied to the cap, there is little fear that the cap installed in the inlet port might be detached or come off from the inlet port.

According to the present teaching, since the cap is provided with the plurality of stoppers, separately from the seal portion and the plurality of stoppers are provided on the cap while being spaced from each other in the circumferential direction of the cap. Therefore, it is possible to install and detach (remove) the cap with respect to the inlet port with a relatively weak force.

Further, according to the present teaching, when the cap is removed from the inlet port, the cap which has been elastically deformed returns to its original shape with a relatively weak force, it is possible to suppress any scattering of the liquid such as the ink adhered to the cap.

Furthermore, according to the present teaching, since the abutting surfaces of the stoppers contact the tank, there is little fear that the cap might be detached or come off from the inlet port even in a case that the inner pressure in the tank becomes greater than the atmospheric pressure, or in another case that the tank is turned upside down in the up-down direction and the weight of the liquid inside the tank is applied to the cap.

BRIEF DESCRIPTION OF THE DRAWINGS

FIGS. 1A and 1B are external perspective views each depicting an example of a multi-function peripheral 10 according to an embodiment of the present teaching, wherein FIG. 1A depicts a state that a cover 70 is closed, and FIG. 1B depicts a state that the cover 70 is opened.

FIGS. 6A and 6B are cross-sectional views each depicting a cap 113 and an inlet port 112, wherein FIG. 6A is a view depicting a state before the cap 113 is installed in the inlet port 112, and FIG. 6B is a view depicting a state that the cap 113 is installed in the inlet port 112.

FIGS. 7A to 7C are views each depicting the shape of the cap 113, wherein FIG. 7A is a plane view, FIG. 7B is a front cross-sectional view, FIG. 7C is a bottom view of the cap 113; FIGS. 7D to 7F are views each depicting a cap 113 in a first modification, wherein FIG. 7D is a plane view, FIG. 7E is a front cross-sectional view, and FIG. 7E is a bottom view of the cap 113.

FIGS. 8A to 8C are views each depicting the shape of a cap 113 in a second modification, wherein FIG. 8A is a plane view, FIG. 8B is a front cross-sectional view, and FIG. 8C is a bottom view of the cap 113.

FIGS. 9A and 9B are cross-sectional views each depicting a cap 113, an inner lid 161 and an inlet port 112 in a third modification, wherein FIG. 9A is a view depicting a state before the cap 113 and the inner lid 116 are installed in the inlet port 112, and FIG. 9B is a view depicting a state that the cap 113 and the inner lid 116 are installed in the inlet port 112.

FIGS. 10A to 10C are views each depicting the shape of the inner lid 116 in the third modification, wherein FIG. 10A is a plane view, FIG. 10B is a front cross-sectional view, and FIG. 10C is a bottom view of the inner lid 116.

FIGS. 11A to 11C are views each depicting the shape of the cap 113 in the third modification, wherein FIG. 11A is a plane view, FIG. 11B is a front cross-sectional view, and FIG. 11C is a bottom view of the cap 113.

FIGS. 12A to 12C are views each depicting the shape of a cap 113 in a fourth modification, wherein FIG. 12A is a plane view, FIG. 12B is a front cross-sectional view, and FIG. 12C is a bottom view of the cap 113.

FIGS. 13A and 13B are cross-sectional views each depicting a cap 113 and an inlet port 112 in a fifth modification, wherein FIG. 13A is a view depicting a state before the cap 113 is installed in the inlet port 112, and FIG. 13B is a view depicting a state that the cap 113 is installed in the inlet port 112.

FIGS. 14A and 14B are perspective views each depicting the shape of a cap 113 in the fifth modification, wherein FIG. 14A is a view depicting a cap 113 provided with a holding portion 221, and FIG. 14B is a view depicting a cap 113 provided with a holding portion 225.

FIGS. 15A to 15C are views each depicting the shape of an inlet port 192 in a second embodiment, wherein FIG. 15A is a plane view, FIG. 15B is a front cross-sectional view, and FIG. 15C is a bottom view of the inlet port 192.

FIGS. 16A to 16C are views each depicting the shape of a cap 191 in the second embodiment, wherein FIG. 16A is a plane view, FIG. 16B is a front cross-sectional view, and FIG. 16C is a bottom view of the cap 191.

FIGS. 17A to 17C are views each depicting the shape of a cap 210 in a third embodiment, wherein FIG. 17A is a plane view, FIG. 17B is a front cross-sectional view, and FIG. 17C is a bottom view of the cap 210.

DESCRIPTION OF THE EMBODIMENTS

Figure 1A:
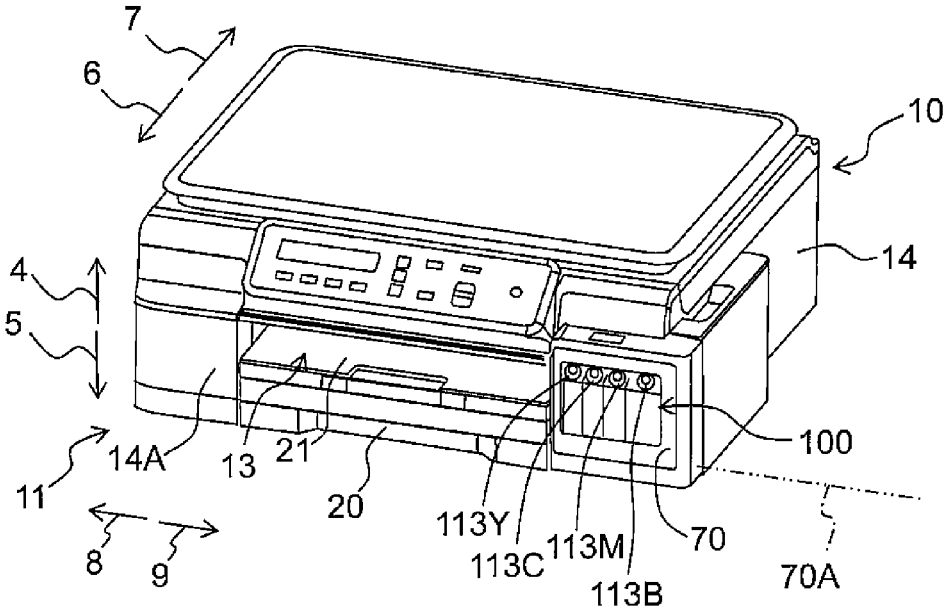

An embodiment of the present teaching will be described below. Note that, however, the embodiment described below is merely an example of the present teaching; it goes without saying that it is possible to make any appropriate change(s) in the embodiment of the present teaching without departing from the gist and/or scope of the present teaching. A state that a multi-function peripheral 10 is usably installed (a state depicted in FIGS. 1A and 1B) will be referred to as a "usable state". Further, a posture in which the multi-function peripheral 10 is usably installed (a posture depicted in FIGS. 1A and 1B) will be referred to as a "usable posture". An up direction 4 and a down direction 5 are defined with the "usable state" or the "usable posture" as the reference. Further, a front direction 6 and a rear direction 7 are defined such that a side on which an opening 13 of the multi-function peripheral 10 is provided is designated as the frontward side (front surface or front side), and a left direction 8 and a right direction 9 are defined as viewing the multi-function peripheral 10 from the frontward side (front surface). Furthermore, in the embodiment, the up direction 4 and the down direction 5 (up and down directions 4 and 5) correspond to the vertical direction, and each of the front direction 6 and the rear direction 7 (front and rear directions 6 and 7), and the left direction 8 and the right direction 9 (left and right directions 8 and 9) corresponds to the horizontal direction.

<Overall Configuration of Multi-Function Peripheral 10>

Figure 1B:
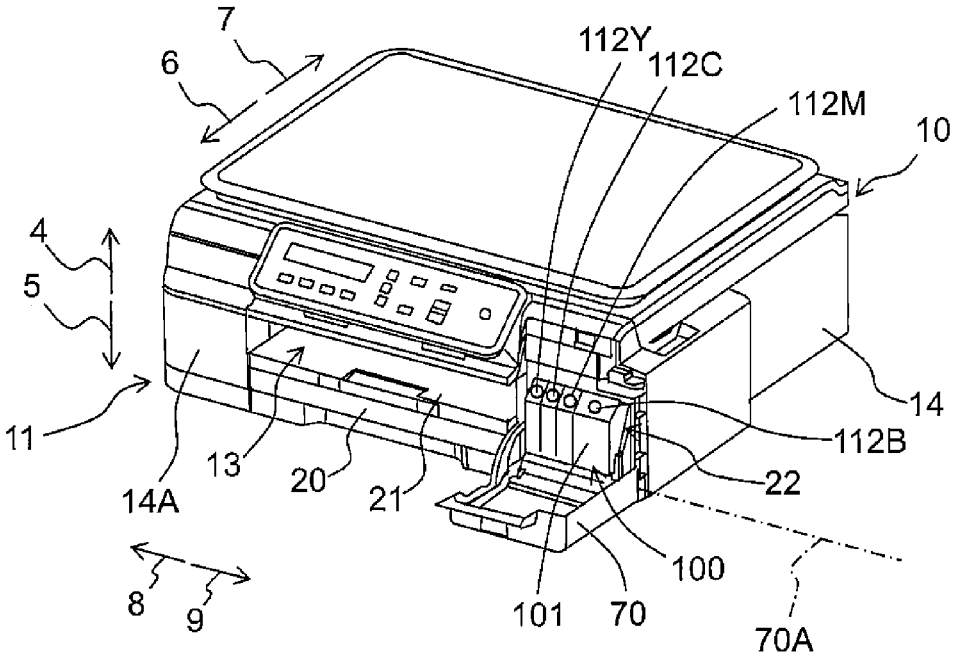
Figure 2:
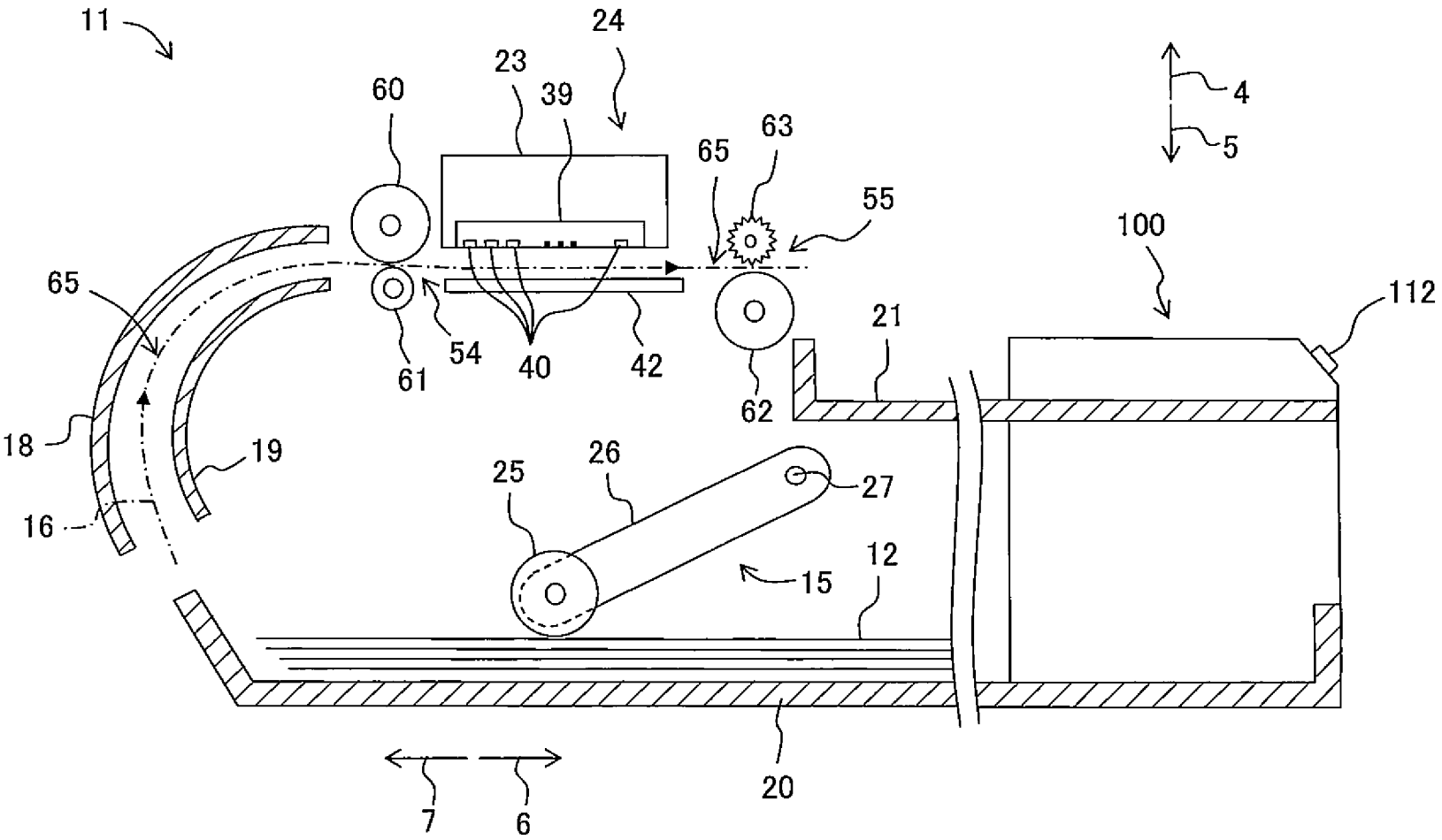
FIG. 2 is a vertical cross-sectional view schematically depicting the internal structure of a printer unit 11.

As depicted in FIGS. 1A and 1B, the multi-function peripheral 10 is formed to have a substantially rectangular parallelepiped shape. The multi-function peripheral 10 includes, at a lower portion of the multi-function peripheral 10, a printer unit 11 which records an image onto a paper 12 (see FIG. 2) by an ink-jet recording method. As depicted in FIG. 2, the printer unit 11 includes a feeding section 15, a feeding tray 20, a discharge tray 21, a conveyance roller section 54, a recording section 24, a discharge roller section 55, a platen 42, and an ink tank 100 (an example of a tank). Further, the multi-function peripheral 10 has various functions such as a facsimile function and a print function.

<Feeding Tray 20, Discharge Tray 21>

As depicted in FIGS. 1A and 1B, the feeding tray 20 is inserted into or removed from the multi-function peripheral 10 by a user, in the front and rear directions 6 and 7 through the opening 13. The opening 13 is formed in a central portion in the left and right directions 8 and 9 of the front surface of the multi-function peripheral 10. The feeding tray 20 is capable of supporting a plurality of sheets of the paper 12 that are stacked in the feeding tray 20. The discharge tray 21 is arranged at a position at the upper side of the feeding tray 20, and is inserted or removed together with the feeding tray 20. The discharge tray 21 supports the paper 12 discharged through a space between the recording section 24 and the platen 42 by the discharge roller section 55.

<Feeding Section 15>

The feeding section 15 feeds the paper 12 supported by the feeding tray 20 to a conveyance route 65 (to be described later on). As depicted in FIG. 2, the feeding section 15 includes a feeding roller 25, a feeding arm 26, and a shaft 27. The feeding roller 25 is rotatably supported by the feeding arm 26 at a front end thereof. The feeding roller 25 rotates in a direction for causing the paper 12 to be conveyed in a conveyance direction 16 when a conveyance motor (not depicted in the drawings) is reversely rotated. In the following description, the rotations of the feeding roller 25, a conveyance roller 60 (to be described later on), and a discharge roller 62 (to be described later on) in the direction for causing the paper 12 to be conveyed in the conveyance direction 16 are each referred to as "normal rotation". The feeding arm 26 is pivotably supported by the shaft 27 supported by a frame of the printer unit 11. A bias is applied to the feeding arm 26 by an elastic force of a spring or by the self-weight of the feeding arm 26 such that the feeding arm 26 is pivoted and urged toward the feeding tray 20.

<Conveyance Route 65>

Figure 3:
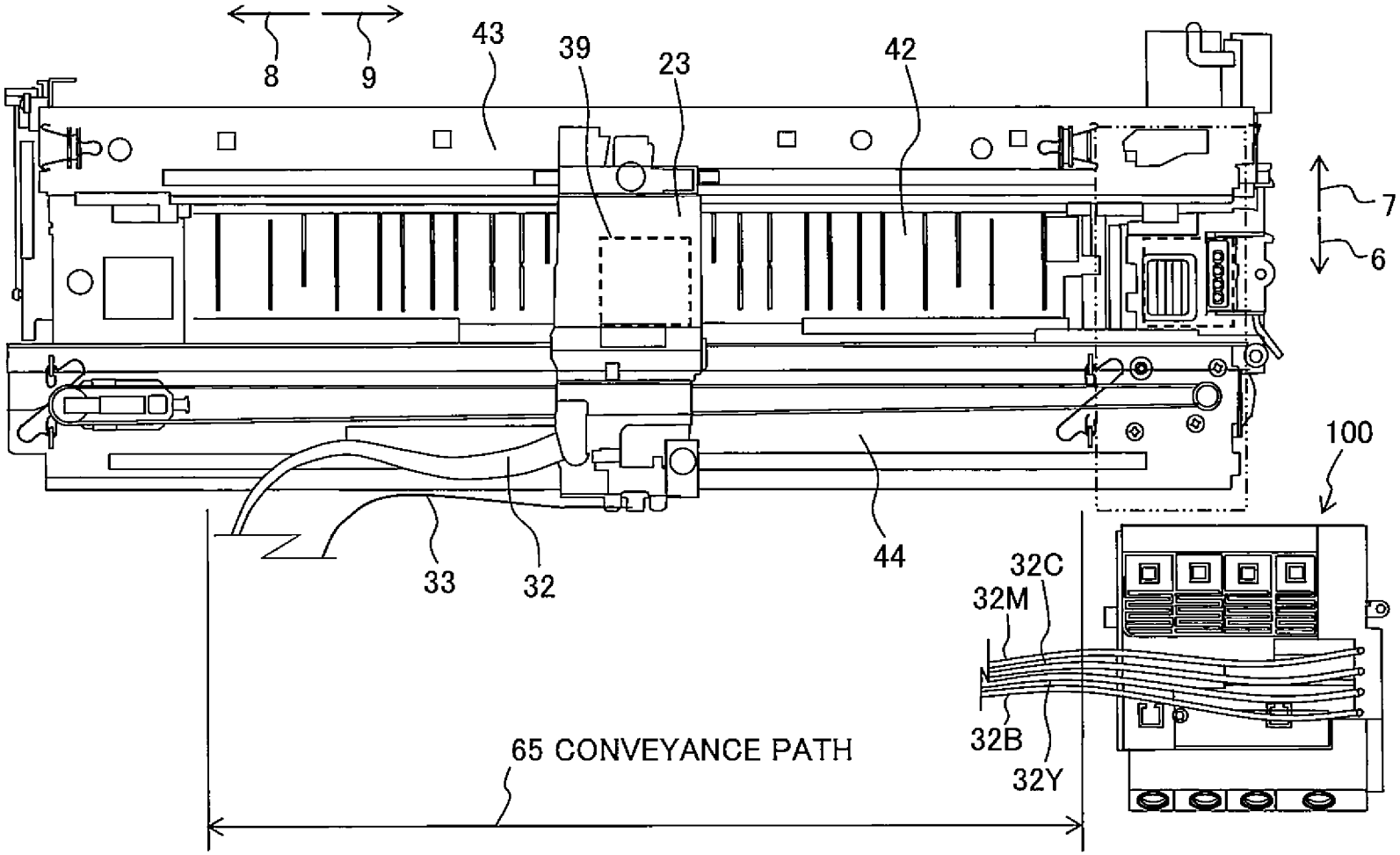
FIG. 3 is a plane view depicting arrangement of a carriage 23 and an ink tank 100.

As depicted in FIG. 2, in the interior of the printer unit 11, a space is defined by an outer guide member 18 and an inner guide member 19 which are arranged to face with each other with a predetermined interval (gap) intervened therebetween. This space constructs a portion of a conveyance route 65. The conveyance route 65 is a route or path that is extended from a rear-end portion of the feeding tray 20 toward the rear side of the printer unit 11. Further, the conveyance route 65 makes a U-turn while being extended from the lower side to the upper side, at the rear side of the printer unit 11; and then the conveyance route 65 reaches the discharge tray 21 via a space between the recording section 24 and the platen 42. As depicted in FIGS. 2 and 3, a portion of the conveyance route 65 between the conveyance roller section 54 and the discharge roller section 55 is provided at a substantially central portion in the left and right directions 8 and 9 of the multi-function peripheral 10, and is extended in the front and rear directions 6 and 7. Note that in FIG. 2, the conveyance direction 16 of the paper 12 in the conveyance route 65 is indicated by an arrow of a dashed-dotted line.

<Conveyance Roller Section 54>

As depicted in FIG. 2, the conveyance roller section 54 is arranged at the upstream side of the recording section 24 in the conveyance direction 16. The conveyance roller section 54 includes a conveyance roller 60 and a pinch roller 61 which are facing each other. The conveyance roller 60 is driven by a conveyance motor. The pinch roller 61 rotates following the rotation of the conveyance roller 60. The paper 12 is conveyed in the conveyance direction 16 by being pinched between the conveyance roller 60 and the pinch roller 61 which are rotated positively by the normal rotation of the conveyance motor.

<Discharge Roller Section 55>

As depicted in FIG. 2, the discharge roller section 55 is arranged at the downstream side of the recording section 24 in the conveyance direction 16. The discharge roller section 55 includes a discharge roller 62 and a spur 63 which are facing each other. The discharge roller 62 is driven by the conveyance motor. The spur 63 rotates following the rotation of the discharge roller 62. The paper 12 is conveyed in the conveyance direction 16 by being pinched between the discharge roller 62 and the spur 63 which are rotated positively by the normal rotation of the conveyance motor.

<Recording Section 24>

As depicted in FIG. 2, the recording section 24 is arranged between the conveyance roller section 54 and the discharge roller section 55 in the conveyance direction 16. Further, the platen 42 and the recording section 24 are arranged to face each other in the up and down directions 4 and 5, while sandwiching the conveyance route 65 therebetween. Namely, the recording section 24 is arranged at a position at which the recording section 24 is located above the conveyance route 65 in the up direction 4 and at which the recording section 24 faces the conveyance route 65. The recording section 24 includes a carriage 23 and a recording head 39.

As depicted in FIG. 3, the carriage 23 is supported by guide rails 43 and 44 which are extended respectively in the left and right directions 8 and 9, at positions separated respectively in the front and rear directions 6 and 7. The guide rails 43 and 44 are supported by the frame of the printer unit 11. The carriage 23 is connected to a known belt mechanism disposed on the guide rail 44. The belt mechanism is driven by a carriage motor (not depicted in the drawings). Namely, the carriage 23 connected to the belt mechanism reciprocates in the left and right directions 8 and 9 by being driven by the carriage motor.

Further, an ink tube 32 which connects the ink tank 100 and the recording head 39 and a flexible flat cable 33 which electrically connects the recording head 39 and a control circuit board having a controller (not depicted in the drawings) mounted thereon are extended from the carriage 23. The ink tube 32 supplies an ink stored in the ink tank 100 to the recording head 39. More specifically, four ink tubes 32B, 32M, 32C, and 32Y via which inks of respective colors (which are, for example, black, magenta, cyan, and yellow colors) are distributed are extended from the ink tank 100, and are connected to the carriage 23 in a bundled form (in the following description, these four ink tubes 32B, 32M, 32C, and 32Y will be collectively referred to as "ink tube(s) 32" in some cases). The flexible flat cable 33 transmits a control signal output from the controller to the recording head 39.

As depicted in FIG. 2, the recording head 39 is installed on the carriage 23. A plurality of nozzles 40 is formed in the lower surface of the recording head 39. End portions (forward end or tip portions) of the nozzles 40 are exposed from the lower surface of the recording head 39 and from the lower surface of the carriage 23 on which the recording head 39 is installed. In the following description, the surface through which the end portions of the nozzles 40 are exposed will be referred to as a "nozzle surface" in some cases. The recording head 39 jets or discharges the ink as fine ink droplets (minute ink droplets) through the nozzles 40. In a process of movement of the carriage 23, the recording head 39 jets the ink droplets toward the paper 12 supported by the platen 42. Accordingly, an image, etc. is recorded on the paper 12. The nozzles 40 are an example of the liquid discharging section.

<Platen 42>

As depicted in FIGS. 2 and 3, the platen 42 is arranged between the conveyance roller section 54 and the discharge roller section 55 in the conveyance direction 16. The platen 42 is arranged so as to face the recording section 24 in the up and down directions 4 and 5, and supports the paper 12, conveyed by the conveyance roller section 54, from therebelow.

<Ink Tank 100>

As depicted in FIGS. 1A and 1B, the ink tank 100 is accommodated inside a casing 14 of the multi-function peripheral 10. The ink tank 100 is fixed to the multi-function peripheral 10 such that the ink tank 100 cannot be easily removed from the multi-function peripheral 10.

The front surface of the ink tank 100 is exposed to the outside of the multi-function peripheral 10 via an opening 22 formed in a front wall 14A of the casing 14. The opening 22 is adjacent to the opening 13 in the left and right directions 8 and 9. Further, the casing 14 is provided with a cover 70 pivotable (rotatable) between a closed position at which the cover 70 covers the opening 22 (see FIG. 1A), and an opened position at which the cover 70 is opened to thereby allow the opening 22 to be exposed to the outside of the multi-function peripheral 10 and at which the cover 70 does not cover the opening 22 (see FIG. 1B). The cover 70 is supported by the casing 14 to be pivotable about a rotational axis 70A extended in the left and right directions 8 and 9 at a lower end portion in the down direction 5 of the casing 14.

Figure 4:
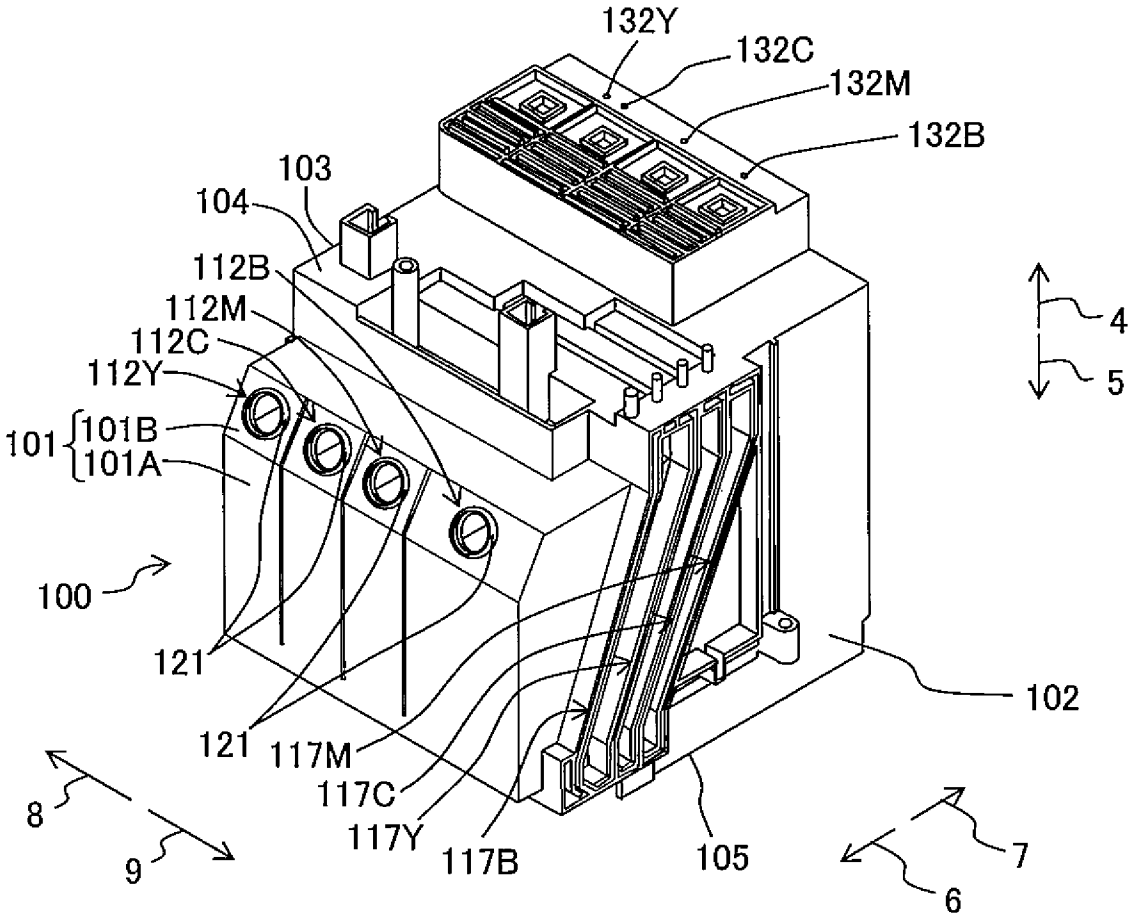
FIG. 4 is a front perspective view of the ink tank 100.
Figure 5:
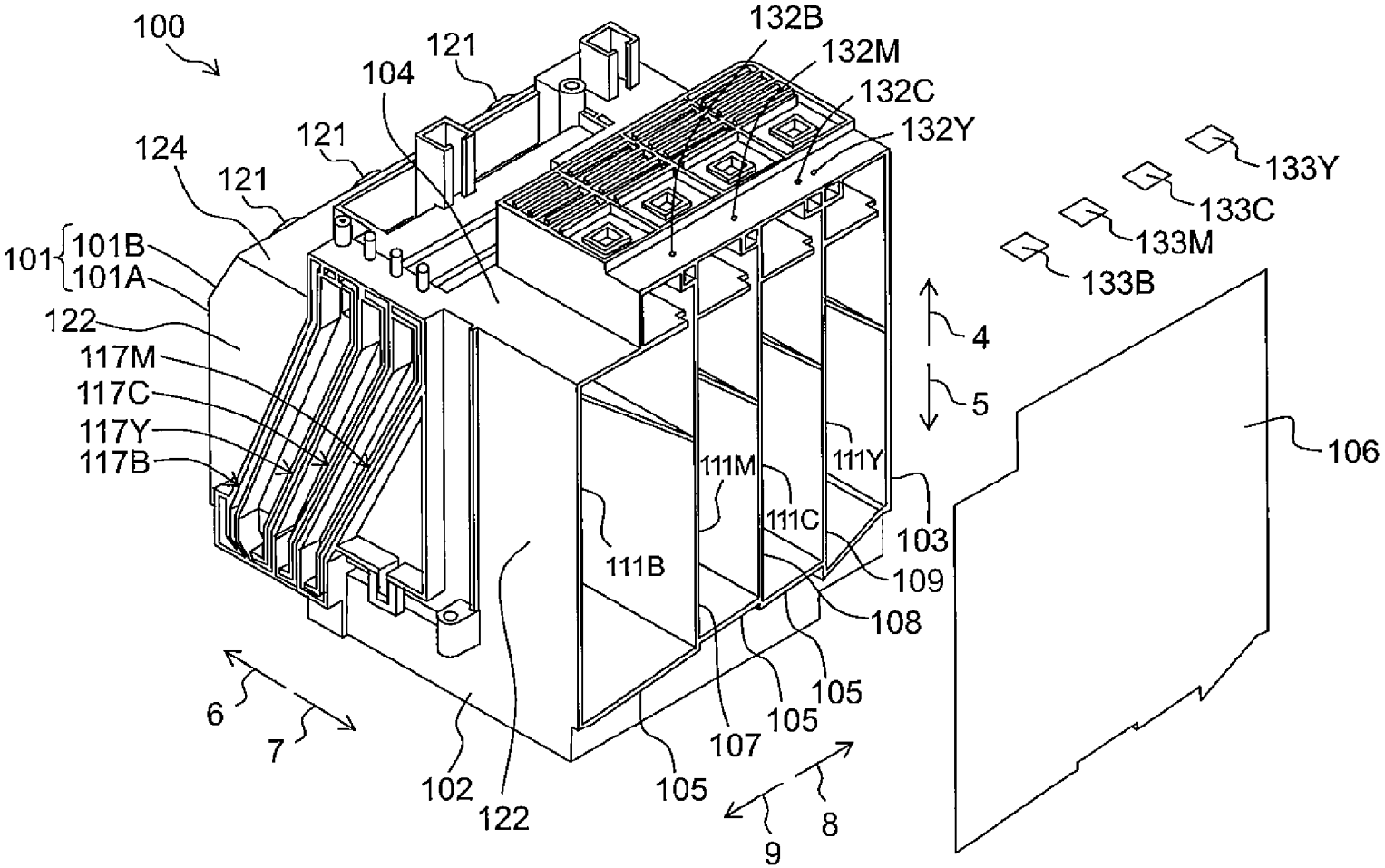
FIG. 5 is a rear perspective view of the ink tank 100.

As depicted in FIGS. 4 and 5, the ink tank 100 has an outer shape that is substantially rectangular parallelepiped. The ink tank 100 has a front wall 101, a right wall 102, a left wall 103, an upper wall 104, and a lower wall 105. The front wall 101 is constructed of a standing wall 101A extending from the lower wall 105 substantially in the up and down directions 4 and 5 and an inclined wall 101B which is connected or continued to the upper end of the standing wall 101A and which is inclined relative to the up and down directions 4 and 5 and the front and rear directions 6 and 7. Further, the upper surface, of the lower wall 101B constructing the bottom surface of an ink chamber 111 (to be described later on) is inclined downward and rightward. On the other hand, the rear surface of the ink tank 100 is opened or uncovered. Further, by fixing a film 106 by welding to rear-end surfaces of the right wall 102, the left wall 103, the upper wall 104 and the lower wall 105, the rear surface of the ink tank 100 is sealed. Namely, the film 106 forms the rear wall of the ink tank 100.

<Ink Chamber 111>

As depicted in FIG. 5, a plurality of partition walls 107, 108 and 109 which define or demarcate the internal space of the ink tank 100 is provided in the interior of the ink tank 100. Each of the partition walls 107, 108 and 109 is extended in the up and down directions 4 and 5 and the front and rear directions 6 and 7, and is connected to the front wall 101, the upper wall 104, the lower wall 105 and the film 106. Further, the partition walls 107, 108 and 109 are disposed to be separated and away from one another in the left and right directions 8 and 9. As a result, the internal space of the ink tank 100 is partitioned into four ink chambers 111B, 111M, 111C and 111Y that are adjacent in the left and right directions 8 and 9. The ink chambers 111B, 111M, 111C and 111Y are each an example of a liquid storage chamber for storing ink to be jetted through the nozzles 40.

The ink chamber 111B is a space demarcated by the front wall 101, the right wall 102, the upper wall 104, the lower wall 105, the film 106 and the partition wall 107. The ink chamber 111M is a space demarcated by the front wall 101, the upper wall 104, the lower wall 105, the film 106 and the partition walls 107 and 108. The ink chamber 111C is a space demarcated by the front wall 101, the upper wall 104, the lower wall 105, the film 106 and the partition walls 108 and 109. The ink chamber 111Y is a space demarcated by the front wall 101, the left wall 103, the upper wall 104, the lower wall 105, the film 106 and the partition wall 109.

In the following description, the ink chambers 111B, 111M, 111C, and 111Y are collectively referred to as "ink chamber(s) 111" in some cases. Further, reference numerals having different alphabetic suffixes (B, M, C, and Y) are assigned to four components provided while corresponding to the ink chambers 111B, 111M, 111C and 111Y, respectively; in a case that these components are collectively referred to, then these components are assigned with a reference numeral(s) while omitting the respective alphabetic suffixes, in some cases.

Inks of different four colors are stored in the ink chambers 111, respectively. Specifically, black ink is stored in the ink chamber 111B, cyan ink is stored in the ink chamber 111C, magenta ink is stored in the ink chamber 111M, and yellow ink is stored in the ink chamber 111Y. Each of the color inks is an example of a liquid. However, the number of ink chambers 111 and the colors of the inks are not limited by or restricted to the number and the colors in the above-described example. The ink chambers 111 are arranged along the left-right directions 8 and 9. Further, among the four ink chambers 111B, 111M, 111C and 111Y, the ink chamber 111B is arranged at the rightmost side and the ink chamber 111Y is arranged at the leftmost side. Furthermore, the ink chamber 111B has a volume larger than the any other ink chambers 111M, 111C and 111Y.

<Inlet Port 112>

The inclined wall 101B of the ink tank 100 is provided with inlet ports 112B, 112M, 112C, and 112Y via which the inks are allowed to flow into the ink chambers 111, respectively. In the following, the inlet ports 112B, 112M, 112C and 112U are collectively referred to as "inlet port(s) 112" in some cases. The inclined wall 101B is an example of an outer wall. The inclined wall 101B has an inner surface 101C facing the ink chamber 111, and an outer surface 101D facing the outside of the ink tank 100. The inclined wall 101B is provided with a cylindrical wall 121 having a cylindrical shape and extending toward the outside of the ink tank 100 in a direction orthogonal to the inclined wall 101B. The detail of the cylindrical wall 121 will be described later on. The inlet port 112 penetrates through the inclined wall 101B in a direction of the thickness of the inclined wall 101B, passes the inside of the cylindrical wall 121, and makes the corresponding ink chamber 111 communicate with the outside of the ink tank 100.

The inclined wall 101B and the inlet port 112 provided on the cylindrical wall 121 are exposed to the outside of the multi-function peripheral 10 when the cover 70 is positioned at the opened position as depicted in FIG. 1B. In the present embodiment, the posture of the ink tank 100 when the ink can be poured into the ink chamber 111 through the inlet port 112 (pouring posture, refilling posture) coincides with the posture of the ink tank 100 when the multi-function peripheral 10 is in the usable posture. Namely, when the multi-function peripheral 10 is in the usable posture, the ink is poured or refilled into the ink chamber 111 through the inlet port 112. Although the inlet port 112 is circular-shaped in this embodiment, the shape of the inlet port 112 is not limited to this; the inlet port 112 may have an elliptical shape, a polygonal shape, etc.

The ink tank 100 has caps 113B, 113M, 113C and 113Y that are detachable and attachable with respect to the inlet ports 112, respectively. In the following, the caps 113B, 113M, 113C and 113Y are collectively referred to as "cap(s) 113" in some cases. As depicted in FIG. 1A, the cap 113 attached to the inlet port 112 blocks or closes the inlet port 112 by making a tight contact with the periphery of the inlet port 112. On the other hand, as depicted in FIG. 1B, in a case that the cap 113 is removed from the inlet port 112, the inlet port 112 is open or released. The cap 113 is attached to and removed or detached from the inlet port 112 in a state that the cover 70 is located at the opened position. Further, by removing the cap 113 from the inlet port 112, the ink can be poured or refilled into the ink chamber 111 via the inlet port 112. The detail of the cap 113 will be described later on.

<Ink Outflow Channel and Atmosphere Communicating Hole>

As depicted in FIGS. 4 and 5, ink outflow channels 117B, 117M, 117C and 117Y are connected to the ink chambers 111B, 111M, 113C and 113Y, respectively. Each of the ink outflow channels 117B, 117M, 117C and 117Y is a channel that allows the ink stored in the corresponding ink chamber 111 to flow out of the ink tank 100. The ink outflow channels 117B, 117M, 117C and 117Y are formed in the ink tank 100. An end of each of the ink outflow channels 117B, 117M, 117C and 117Y is connected to the ink chamber 111 corresponding thereto; the other end of each of the ink outflow channels 117B, 117M, 117C and 117Y is connected to the ink tube 32 corresponding thereto. With this, the ink stored in each of the ink chambers 111 is supplied to the recording head 39 via one of ink outflow channels 117B, 117M, 117C and 117Y and one of the ink tubes 32 which correspond to the ink chamber 111. A portion of each of the ink outflow channels 117B, 117M, 117C and 117Y is formed by covering a groove, formed in the right wall 102, with a non-illustrated film. In the following, the ink outflow channels 117B, 117M, 117C and 117Y are collectively referred to as "ink outflow channel(s) 117" in some cases. The ink outflow channel(s) 117 is/are an example of an outlet port.

Further, the ink chambers 111B, 111M, 111C and 111Y are provided with atmosphere communicating holes 132B, 132M, 132C and 132Y, respectively. Each of the atmosphere communicating holes 132B, 132M, 132C and 132Y allows the ink chamber 111 corresponding thereto to communicate with the atmosphere. With this, the internal pressure in each of the ink chambers 111 is maintained at the atmospheric pressure. As a result, it is possible to suppress any excessive supply of the ink due to the increase in internal pressure in the ink chamber 111, or any backflow of the ink due to the decrease in internal pressure in the ink chamber 111, etc. Further, the atmosphere communicating holes 132B, 132M, 132C and 132Y are provided with semipermeable membranes 133B, 133M, 133C and 133Y, respectively, which are adhered thereto and configured to prevent any leakage of the ink. A portion of each of the channels starting from the ink chambers 111B, 111M, 111C and 111Y and reaching the atmosphere communicating holes 132B, 132M, 132C and 132Y is formed by covering a groove formed in the upper wall 104 with a non-illustrated film. In the following, the atmosphere communicating holes 132B, 132M, 132C and 132Y are collectively referred to as "atmosphere communicating hole(s) 132" in some cases. The atmosphere communicating hole(s) 132 is/are an example of the atmosphere communicating portion. Further, the semipermeable membranes 133B, 133M, 133C and 133Y are collectively referred to as "semipermeable membrane(s) 133" in some cases.

<Cylindrical Wall 121>

Figure 6A:
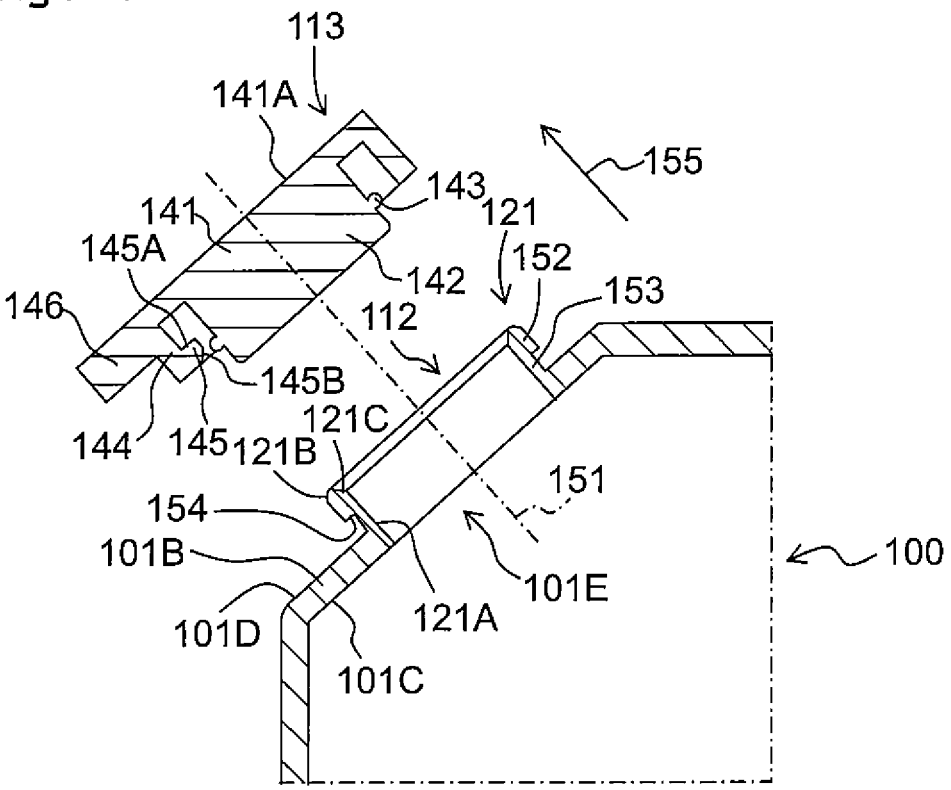

Each of the inlet ports 112 are provided with a cylindrical wall 121, as depicted in FIG. 6A.

The cylindrical wall 121 has a substantially cylindrical shape of which center is a central axis line 151. The cylindrical wall 121 extends from the periphery of an opening 101E provided on the inclined wall 101B of the ink tank 100 in a direction 155 orthogonal to the inclined wall 101B and oriented toward the outside of the ink tank 100 (hereinafter referred to as a "first direction 155"). Namely, the central axis line 151 extends along the first direction 155. The first direction 155 is a direction crossing or intersecting the up direction 4, the down direction 5, the front direction 6 and the rear direction 7, and is a direction having a component in the front direction 6 and a component in the up direction 4. Further, in the following description of the cap 113, the relationship between the respective directions and the central axis line 151, and the cap 113 in a state that the cap 113 is installed in the cylindrical wall 121. Note that the opening 101E is a portion of the inlet port 112.

The cylindrical wall 121 is composed of a first portion 152 and a second portion 153. Each of the first portion 152 and the second portion 153 has a cylindrical shape. The first portion 152 and the second portion 153 are integrally formed in a state that the second portion 153 and the first portion 152 are stacked in this order on the peripheral edge portion, of the inclined surface 101, defining the opening 101E, from the side closer to the inclined wall 101, with the central axes of the cylindrical shapes of the first and second portions 152 and 153 being made to be coincident or matched with each other. A line passing through the central axes of the first and second portions 152 and 153 is the central axis line 151. The inner circumferential surfaces of the first portion 152, the second portion 153 and the opening 101E are (define) an inner circumferential surface 121A defining the inlet port 121A. The inner circumferential surfaces of the first portion 152, of the second portion 153 and of the opening 101E have a same inner diameter, and are located on one virtual cylindrical surface. The central axis line 151 of the cylindrical wall 121 is also the central axis line 151 of the inlet port 112.

The outer diameter of the second portion 153 is smaller than the outer diameter of the first portion 152. The outer circumferential surface of the first portion 152 and the outer circumferential surface of the second portion 153 are connected by a connecting surface 154. The connecting surface 154 is expanded along a plane orthogonal to the central axis line 151. Thus, a concavity or dent portion recessed toward the central axis line 151 is formed between the outer circumferential surface of the first portion 152 and the outer circumferential surface of the second portion 153. An end surface, of the first portion 152, in the first direction 155 forms an outer guide surface 121B which is inclined with respect to the first direction 155 so as to approach more closely to the inclined wall 101B wall as separating farther from the central axis line 151, and an inner guide surface 121C which is inclined with respect to the first direction 155 so as to approach more closely to the inclined surface 101B as approaching more closely to the central axis line 151.

<Cap 113>

Figure 6B:
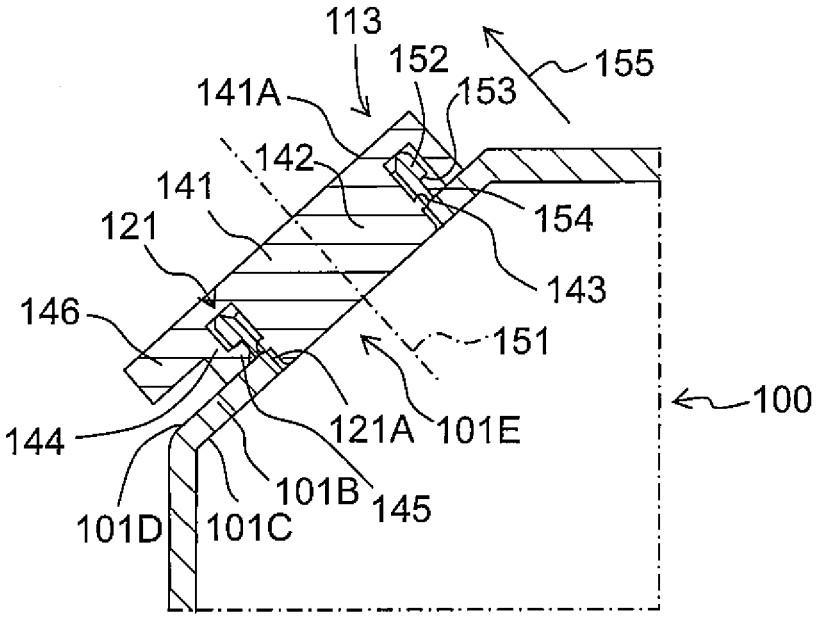

The cap(s) 113 depicted in FIGS. 6A and 6B and FIGS. 7A to 7F is/are attachable and detachable (removable) with respect to the inlet port 112 of the ink tank 100. The cap 113 is movable to an open state wherein the cap 113 is not attached to the inlet port 112 and thus allows the inlet port 112 to be released (opened) as depicted in FIG. 6A, and to a close (clog) state wherein the cap 113 closes the inlet port 112 as depicted in FIG. 6B. In the embodiment, the close state wherein the cap 113 closes the inlet port 112 is a state that the inlet port 112 of the ink tank 100 is closed by the cap 113 with respect to the outside thereof, and that the ink cannot be poured into the ink chamber 111 via the inlet port 112 from the outside of the ink tank 100. The open state wherein the cap 113 allows the inlet port 112 to be opened (released) is a state that the cap 113 is detached (removed) from the inlet port 112 and the ink can be poured into the ink chamber 111 via the released inlet port 112 from the outside of the ink tank 100. As depicted in FIGS. 1A and 1B, the cap 113 is provided as four caps 113B, 113M, 113C and 113Y corresponding to the four inlet ports 112B, 112M, 112C and 112Y of the ink tank 100, respectively. The respective caps 113B, 113M, 113C and 113Y are colored in the colors of the inks stored in the ink chambers 111 corresponding to the caps 113B, 113M, 113C and 113Y, respectively. Specifically, the cap 113B is colored in black, the cap 113M is colored in magenta, the cap 113C is colored in cyan and the cap 113Y is colored in yellow. Since the respective caps 113B, 113M, 113C and 113Y have a same shape, the caps 113B, 113M, 113C and 113Y are collectively referred to as the "cap 113(s)" and will be described in details in the following explanation.

The cap 113 is formed, for example, of a synthetic resin such as polypropylene (PP). Although the synthetic resin used to form the cap 113 has a high modulus of elasticity as compared with an elastic material such as rubber, elastomer, etc., the synthetic resin is a material which is elastically deformable. As depicted in FIGS. 7A to 7F, the cap 113 has a substantially columnar outer shape. Since the cap 113 is formed of the elastically deformable material, the cap 113 is thereby deformed when the cap 113 is attached or detached with respect to the inlet port 112, and then returns to the original shape of the cap 113. By allowing the cap 113 to have the high modulus of elasticity as compared with the rubber, elastomer, etc., a holding portion 146 (to be described later on) is not easily bent. Therefore, in a case that the user lifts or raises the holding portion 146, a portion of the cap 113 connected to the holding portion 146 easily moves following the holding portion 146.

The cap 113 is provided with a lid portion 141, an insertion portion 142, a seal portion 143, a connecting portion 144, three stoppers 145 and a holding portion 146.

The lid portion 141 has a disc-shape with the central axis line 151 as the center thereof. The outer diameter of the lid portion 141 is greater than the outer diameter of the cylindrical wall 121. A surface, of the lid portion 141, facing the first direction 155 is defined as a front surface 141A, and a surface, of the lid portion 141, facing a direction opposite to the first direction 155 is defined as a back surface 141B.

The holding portion 146 has a rectangular plate-like shape. The holding portion 146 extends outwardly from the periphery or peripheries of the lid portion 141 and/or the connecting portion 144, in the radial directions of the cylindrical wall 121 and the inlet port 112 which are orthogonal to the central axis line 151.

The insertion portion 142 has a columnar shape. The insertion portion 142 is projecting from a central portion of the back surface 141B of the lid portion 141, in the direction along the central axis line 151. The central axis in the columnar shape of the insertion portion 142 is coincident with the central axis line 151. The outer diameter of the insertion portion 142 is smaller than the outer diameter of the lid portion 141. Further, the outer diameter of the insertion portion 142 is smaller than the inner diameters of the first portion 152, the second portion 153 and the opening 101E, namely is smaller than the inner diameter of the inlet port 112. The insertion portion 142 may be formed to be hollow inside, or may be formed to have a cylindrical or columnar shape.

The seal portion 143 is projecting outwardly from an outer circumferential surface 142A of the insertion portion 142, and is formed to have a ring shape surrounding the outer circumferential surface 142A, with the central axis line 151 as the center of the seal portion 143. The seal portion 143 may be formed integrally with the insertion portion 142, or may be formed as a separate member from the insertion portion 142 and may be wound around the insertion portion 142. The outer diameter of the seal portion 143 is greater than the inner diameters of the first portion 152, the second portion 152 and the opening 101E, namely is greater than the inner diameter of the inlet port 112.

The connecting portion 144 has a cylindrical shape. The connecting portion 144 is projecting from the back surface 141B of the lid portion 141 in the direction along the central axis line 151. An end edge portion 144B, of the connecting portion 144, facing the direction opposite to the first direction 155 is located to be above in the first direction 155 relative to an end edge portion 142B, of the insertion portion 142, facing the direction opposite to the first direction 155. Further, the end edge portion 144B, of the connecting portion 144, facing the direction opposite to the first direction 155 is located at a substantially same position in the first direction 155 as an end edge portion, of the seal portion 143, facing the direction opposite to the first direction 155. The connecting portion 144 has a central axis of the cylindrical shape thereof which is coincident with the central axis line 151. The inner diameter of the connecting portion 144 is greater than the outer diameter of the insertion portion 142. Further, the inner diameter of the connecting portion 144 is greater than the outer diameter of the first portion 152 of the cylindrical wall 121. The connecting portion 144 is provided on the outside of the outer circumferential surface 142A of the insertion portion 142, with an interval (spacing distance, gap) with respect to the insertion portion 142.

An inner circumferential surface 144A of the connecting portion 144 extends, in the direction opposite to the first direction 155, from the back surface 141B of the lid portion 141. The three stoppers 145 are projecting toward the central axis line 151 from the end edge portion 144B, which faces the direction opposite to the first direction 155, in the inner circumferential surface 144A of the connecting portion 144. The three stoppers 145 have a same shape, and each have a substantially flat plate-like shape expanding along a plane orthogonal to the central axis line 151. The three stoppers 145 are arranged with an interval therebetween (while being spaced from one another), in the circumferential direction of the inner circumferential surface 144A of the connecting portion 144, namely the circumferential direction with the first direction 155 and the central axis line 151 as the center thereof. The three stoppers 145 are arranged in the circumferential direction at equal intervals therebetween. Namely, an orthogonal line extending toward the central axis line 151 from the center of a certain stopper 145 among the three stoppers 145 defines an angle of 120 degrees with each of orthogonal lines extending toward the central axis line 151 respectively from the centers of other stoppers 145 among the three stoppers 145. A surface, in the stopper 145, facing the first direction 155 forms an abutting surface 145A having a plane orthogonal to the central axis line 151. A surface, of the stopper 145, facing the direction opposite to the first direction 155, forms a guide surface 145B which is inclined with respect to the first direction 155 so as to approach more closely to the back surface 141B of the lid portion 141 as approaching more closely to the central axis line 151. The diameter of a virtual cylindrical surface, defined by end surfaces of the respective stoppers 145 (surfaces of the stoppers 145 located most closely to the central axis line 151) is smaller than the outer diameter of the first portion 152 of the cylindrical wall 121, and is greater than the outer diameter of the second portion 153 of the cylindrical wall 121. In a case that the cap 113 is seen from the first direction 115, the center of one stopper 145, among the three stoppers 145, is arranged side by side with the center of the holding portion 146 in the radial directions of the cylindrical wall 121 and the inlet port 112.

<Attachment and Detachment of the Cap 113 with Respect to the Inlet Port 112>

In a case that the cap 113 is to be attached to the inlet port 112, the user presses the cap 113 toward the inlet port 112 such that the insertion portion 142 is inserted into the inlet port 112. In this situation, the outer guide surface 121B of the cylindrical wall 121 abuts against (contacts) the guide surface 145B of each of the stoppers 145 while a force moving the cap 113 in the direction opposite to the first direction 155 is applied to the cap 113. With this, the connecting portion 144 is elastically deformed such that the diameter of the connecting portion 144 is expanded (increased) to thereby move the stoppers 145 to the outside of the radial directions of the cylindrical wall 121 and the inlet port 112. As result, the diameter of the virtual cylindrical surface defined by the end surfaces of the three stoppers 145 is expanded (increased). When the cap 113 is to be attached to (installed in) the inlet port 112, whether or not the center of the holding portion 146 and the center of a certain stopper 145, among the three stoppers 145, which is located closely (near) to the holding portion 146 are arranged side by side to each other in the radial directions of the cylindrical wall 121 and the inlet port 112 provided that the cap 113 is seen from the first direction 155 does not particularly affect the action of attachment of the cap 113 to the inlet port 112.

Further, the inner guide surface 121C of the cylindrical wall 121 abuts against the seal portion 143 while the force moving the cap 113 in the direction opposite to the first direction 155 is applied to the cap 113. With this, the seal portion 143 is elastically deformed such that the seal portion 143 is compressed into the inner side of the radial directions of the cylindrical wall 121 and the inlet port 112. As result, the outer diameter of the seal portion 143 is reduced (decreased). With this, a space between the insertion portion 142 and the inner circumferential surface 121A of the cylindrical wall 121 or of the inclined wall 101B is sealed in the liquid-tight manner.

In a case that the cap 113 is continuously pressed into the inlet port 112, the stoppers 145 pass the first portion 152, of the cylindrical wall 121, of which outer diameter is greater than the diameter of the virtual cylindrical surface defined by the end surfaces of the respective stoppers 145, and achieves an installed state as depicted in FIG. 6B. In the installed state, each of the stoppers 145 is located at a position at which the stopper 145 is adjacent, in the radial direction of the cylindrical wall 121, to the second portion 153, of the cylindrical wall 121, of which outer diameter is smaller than the diameter of the virtual cylindrical surface defined by end surfaces of the respective stoppers 145. With this, each of the stoppers 145 is in a state that the force elastically deforming the connecting portion 144 toward the outside of the radial directions of the cylindrical wall 121 and the inlet port 112, which has been applied to each of the stoppers 145 by the first portion 152 of the cylindrical wall 121, is not applied to each of the stoppers 145. As a result, the elastic deformation of the connecting portion 144 is returned to the original shape of the connecting portion 144. In the installed state, the abutting surface 145A of each of the stoppers 145 faces the connecting surface 154 of the cylindrical wall 121, in the first direction 155. Further, the seal portion 143 contacts the inner circumferential surface 121A of the cylindrical wall 121 or of the inclined wall 101B defining the inlet port 112 in the state that the seal portion 143 is compressed into the inner side of the radial directions of the cylindrical wall 121 and of the inlet port 112, to thereby fix the cap 113 to the cylindrical wall 121. In this state, it is allowable that the abutting surface 145A abuts against the connecting surface 154 or does not abut against the connecting surface 154.

In a case of removing (detaching) the cap 113 from the inlet port 112, the user lifts (raises) the holding portion 146 of the cap 113 in the first direction 155 and a direction toward the central axis line 151. In this situation, a portion, of the connecting portion 144, connected to the holding portion 146 is elastically deformed in a direction separating away from the cylindrical wall 121. Then, the certain stopper 145, among the three stoppers 145, which is arranged side by side with the holding portion 146 in the radial directions of the cylindrical wall 121 and the inlet port 112, provided that the cap 113 is seen from the first direction 155, is moved to the outside of the radial direction. As a result, the certain stopper 145 is moved to a position at which the abutting surface 145A of the certain stopper 145 does not face the connecting surface 154 in the first direction 155. In a case that the abutting surface 145A of the one (certain) stopper 145 does not face the connecting surface 154 in the first direction 155, the holding portion 146 is then moved in the first direction 155 and the direction toward the central axis line 151, thereby moving also the abutting surfaces 145A of the remaining stoppers 145 among the three stoppers 145 to positions at which the abutting surfaces 145A of the remaining stoppers 145 do not face the connecting surface 154 in the first direction 155. As a result, the cap 113 is removed (detached) from the inlet port 112.

As described above, the cap 113 has the seal portion 143 and the stoppers 145 which are provided independently from each other. The seal portion 143 has the sealing function to seal the inlet port 112 in the liquid-tight manner. The stoppers 145 have the function of suppressing any detachment of the cap 113 from the inlet port 112. In the embodiment, the cap 113 is elastically deformed such that the cap 113 is moved relative to the ink tank 100 up to the position at which the abutting surfaces 145A of the stoppers 145 can contact the ink tank 100 in the first direction 155, thereby installing the cap 113 in the inlet port 112. Since the three stoppers 145 are provided on the cap 113 while being spaced from one another in the circumferential direction of the cap 113, the cap 113 is elastically deformed with a force smaller than a force in a case that the stoppers 145 are provided on the cap 113 along the entire circumference thereof in the circumferential direction. Thus, the user can install the cap 113 in the inlet port 112 by moving the cap 113, with a relatively small force, up to the position at which the abutting surface 145A of each of the stoppers 145 can contact the connecting surface 154 in the first direction 155. Similarly, the user can remove the cap 113 from the inlet port 112 by releasing the contact of the abutting surface 145A of each of the stoppers 145 with respect to the connecting surface 154, with a relatively small force.

Further, when the cap 113 is (being) detached from the inlet port 112, the force by which the cap 113 which has been elastically deformed returns to its original shape is small. Thus, even if any ink is adhered to the cap 113, it is possible to suppress any scattering of the ink adhered to the cap 113.

Furthermore, since the seal portion 143 and the stoppers 145 are provided independently from each other, the sealing function of the seal portion 143 is not lowered even through the stoppers 145 are not provided along the entire circumference of the cap 113.

Moreover, in a case that the cap 113 is being moved toward the first direction 155 from the state of being installed in the inlet port 112, the abutting surface 145A of each of the stoppers 145 contacts the connecting surface 154 of the cylindrical wall 121, and forces mutually pressing in opposite directions act on the space between the abutting surface 145A of each of the stoppers 145 and the connecting surface 154 of the cylindrical wall 121. Thus, in a case that the inner pressure in the ink tank 100 becomes greater than the atmospheric pressure, or in another case that the ink tank 100 is turned upside down in the up-down direction and the weight of the ink inside the ink tank 100 is applied to the cap 113, there is little fear that the cap 113 installed in the inlet port 112 might be detached or come off from the inlet port 112.

Since the seal portion 143 is elastically deformed to contact the inner circumferential surface 121A of the cylindrical wall 121 or of the inclined wall 101B, the space between the cap 113 and the cylindrical wall 121 or the inclined wall 101B is sealed in the liquid-tight manner.

Since the three stoppers 145 are arranged in the circumferential direction at equal intervals therebetween, the positions at which the three stoppers 145 receive the reaction force respectively from the connecting surface 154 of the cylindrical wall 121 are evenly distributed or dispersed, making it possible to suppress, more stably, any detachment of the cap 113 from the inlet port 112.

When the inner pressure in the ink tank 100 and/or the weight of the ink inside the ink tank 100 are/is applied to the cap 113 installed in the inlet port 112, the abutting surface 145A of each of the plurality of stoppers 145 faces and contacts the connecting surface 154, thereby suppressing the detachment, from the inlet port 112, of the cap 113 installed in the inlet port 112. Further, in the state that the cap 113 is installed in the inlet port 112, the plurality of stoppers 145 are not located at positions, respectively, at which the stoppers 145 contact the ink inside the ink chamber 111. Accordingly, when the cap 113 is being removed from the inlet port 112, the ink otherwise adhered to the stoppers 145 does not scatter.

The cap 113 has a high modulus of elasticity as compared with rubber, elastomer, etc., and the holding portion 146 is adjacent to one stopper 145, among the three stoppers 145, with the connecting portion 144 interposed therebetween. Thus, in a case that the user lifts the holding portion 146 in the first direction 155 and in the direction toward the central axis line 151, the one stopper 145 adjacent to the holding portion 146 is easily moved. Accordingly, the user can easily release the abutting surface 145A, of the stopper 145 adjacent to the holding portion 146, from the contact with the connecting surface 154.

In a state that the cap 113 is installed in the inlet port 112, the space between the insertion portion 142 and the inlet port 112 can be sealed in the liquid-tight manner by the seal portion 143.

By the atmosphere communicating hole 132, the inner pressure and the external pressure of the ink tank 100 are made to be same. Further, the semipermeable membrane 133 suppresses any outflowing of the ink to the outside of the ink tank 100 via the atmosphere communicating hole 132. Note that in a case that the pressure inside the ink tank 100 is suddenly increased with respect to the external pressure of the ink tank 100, a time is required for gas to be discharged from the inside to the outside of the ink tank 100 via the semipermeable membrane 133, and thus the increase in the inner pressure of the ink tank 100 cannot be resolved quickly in some cases. However, even in such a case, the abutting surfaces 145A of the stoppers 145 contact the connecting surface 154 of the cylindrical wall 121 to thereby suppress the detachment of the cap 113 from the inlet port 112.

<First Modification>

Figure 7A:
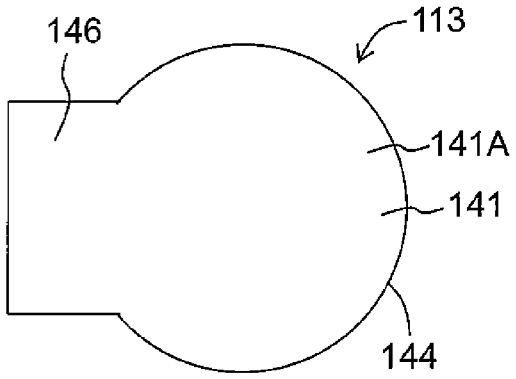
Figure 7D:
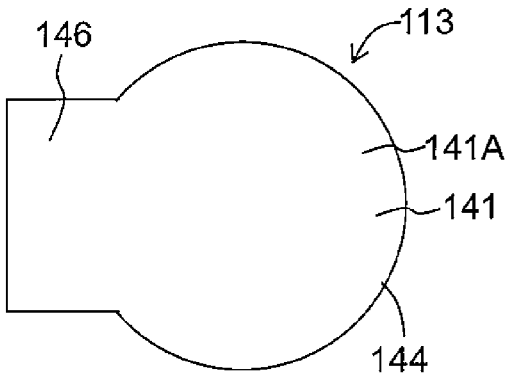
Figure 7B:
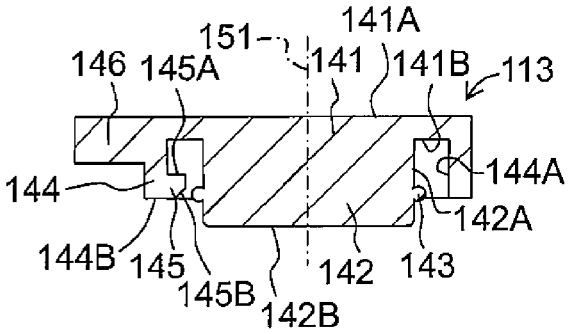
Figure 7E:
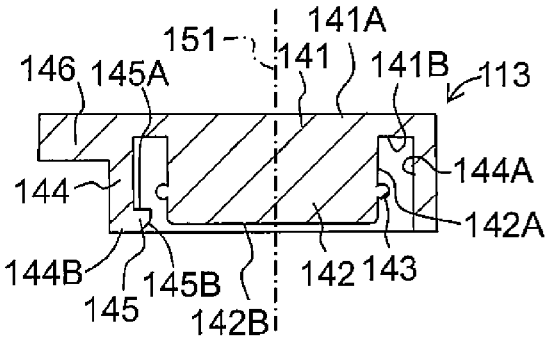
Figure 7C:
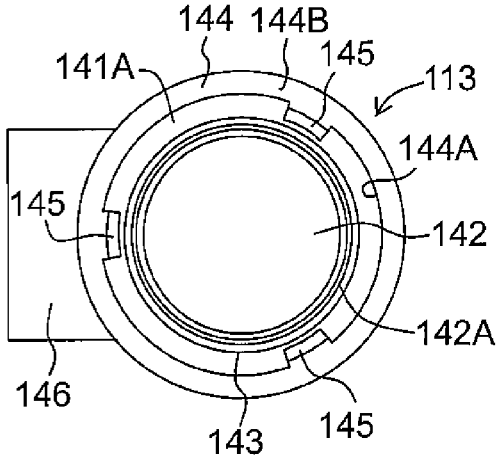
Figure 7F:
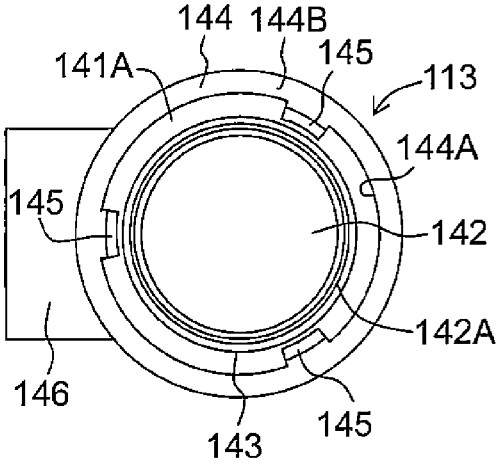

In the above-described embodiment, the end edge portion 142B, of the insertion portion 142, facing the direction opposite to the first direction 155 is located on the opposite side in the first direction 155 to the end edge portion 144B, of the connecting portion 144, facing the direction opposite to the first direction 155. It is allowable, however, that the end edge portion 142B, of the insertion portion 142, facing the direction opposite to the first direction 155 is located to be above in the first direction 155 relative to the end edge portion 144B, of the connecting portion 144, facing the direction opposite to the first direction 155, as depicted in FIGS. 7D, 7E and 7F.

With this configuration, in a case that the cap 113 is placed, for example, on a desktop, with the surface 146A of the lid portion 146 being oriented upward, the end edge portion 144B of the connecting portion 144 contacts the desktop surface. The end surface 142B of the insertion portion 142 is located at a position above the desktop surface, and thus does not contact the desktop surface. Accordingly, even in a case that the ink is adhered to the insertion portion 142, it is possible to suppress any contamination (dirtying) of the desktop surface by the ink.

<Second Modification>

Figure 8A:
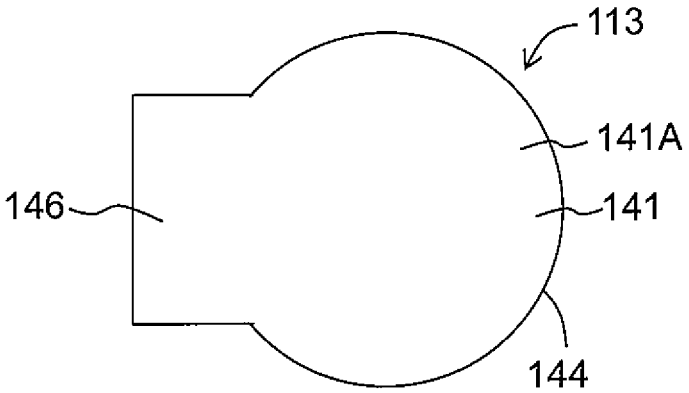
Figure 8B:
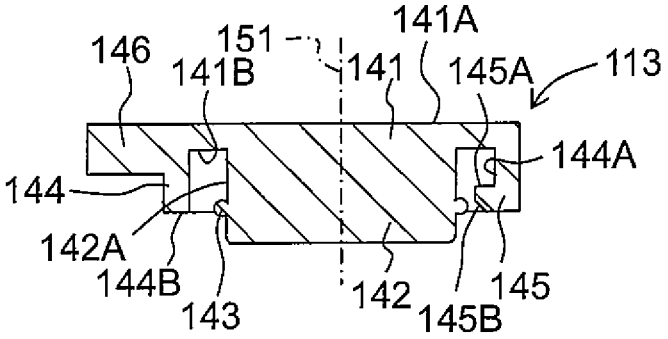
Figure 8C:
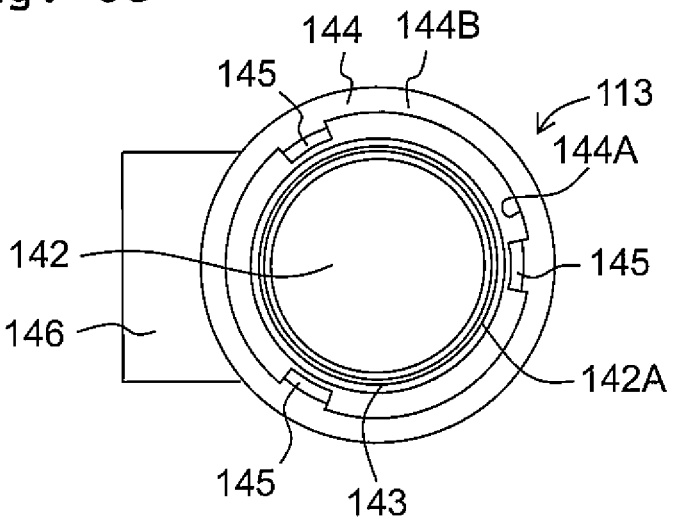

In the above-described embodiment, the cap 113 is entirely formed of the synthetic resin such as polypropylene (PP) having a relatively high modulus of elasticity. It is allowable, however, that in the cap 113, at least the connecting portion 144 and the three stoppers 145 are formed of an elastic material such as rubber, elastomer, etc., having a relatively low modulus of elasticity. In such a case, as depicted in FIGS. 8A to 8C, the three stoppers 145 may be arranged such that the holding portion 146 is located at the center in the circumferential direction, of which center is the first direction 155, of two stoppers 145, among the three stoppers 145, which are adjacent in the circumferential direction and which are arranged closely to the holding portion 146. Namely, under a condition that the cap 113 in the state of being installed in the inlet port 112 is seen in the first direction 155, the holding portion 146 is not arranged side by side with any one of the three stoppers 145 in the radial directions of the cylindrical wall 121 and the inlet port 112.

In the second modification, when comparing the second modification with the above-described embodiment, the modulus of elasticity of the connecting portion 144 is relatively low as compared, for example, PP, etc. Accordingly, even in a case that the holding portion 146 is lifted in the first direction 155 and the direction toward the central axis lines 151, the holding portion 146 rotates with a connection portion at which the holding portion 146 is connected to the connecting portion 144 as the center of rotation, and the connecting portion 144 is hard to move. However, in a case that the holding portion 146 is lifted further in the first direction 155 and the direction toward the central axis line 151, the connecting portion 144 and the two stoppers 145 arranged closely to the holding portion 146, each of the connecting portion 144 and the two stoppers 145 having the low modulus of elasticity, are pulled while being elastically deformed in a twisting manner, which in turn causes the abutting surfaces 145A of the two stoppers 145 to cease facing (being opposite to) the connecting surface 154 in the first direction 155. As a result, the cap 113 is removed from the inlet port 112. Provided that under the condition that the cap 113 in the state of being installed in the inlet port 112 is seen in the first direction 155, the holding portion 146 is arranged side by side with a certain stopper 145, which is included in the three stoppers 145 and which is arranged closely to the holding portion 146, in the radial directions of the cylindrical wall 121 and the inlet port 112, despite of the low moduli of elasticity of the connecting portion 146 and the holding portion 146. In this case, when the holding portion 146 is lifted in the first direction 155 and the direction toward the central axis line 151, the certain stopper 145 arranged closely to the holding portion 146 bites into the connecting surface 154, which in turn might lead to such a possibility that the removal (detachment) of the cap 113 from the inlet port 112 might be difficult.

<Third Modification>

It is allowable that the cap 113 is not provided with the insertion portion 142, as depicted in FIGS. 9A to 9C and FIGS. 11A to 11C. In such a case, the ink tank 100 may be provided with an inner lid 161 as depicted in FIGS. 9A to 9C and FIGS. 10A to 10C. Note that in the third modification, the same reference signs are assigned to the components or parts identical in configuration to the above-described embodiment, and any explanation therefor are omitted.

Figure 9A:
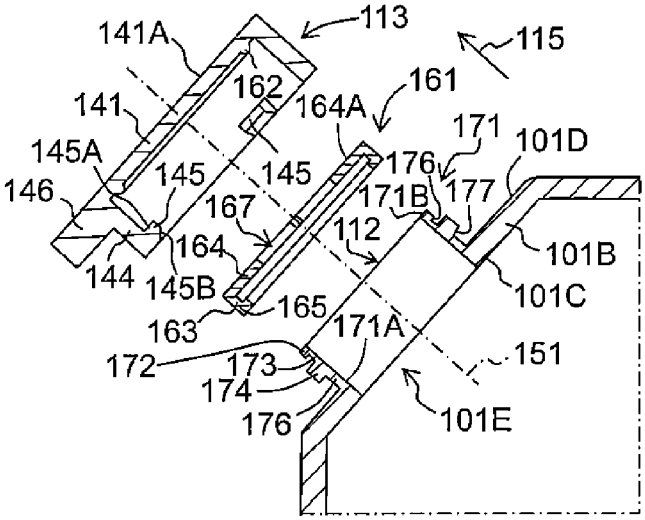
Figure 9B:
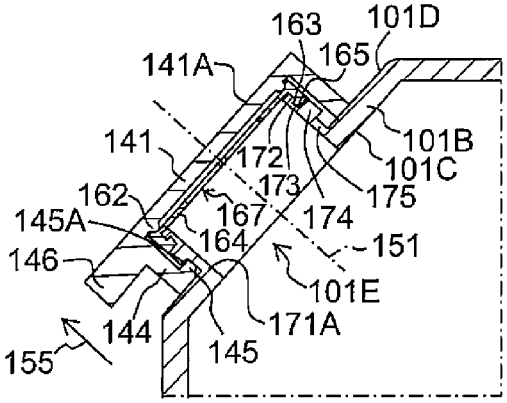
Figure 9C:
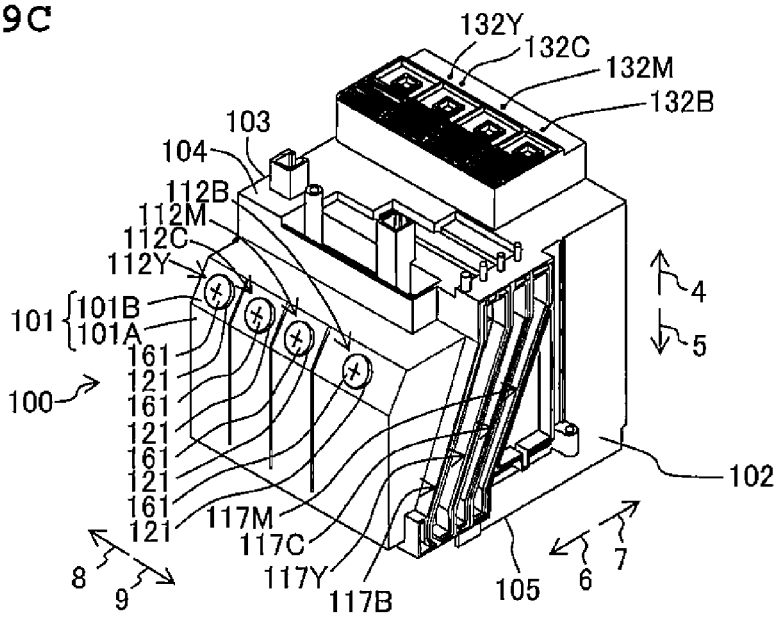
FIG. 9C is a front perspective view of an ink tank 100 in the third modification, depicting a state that the inner lid 116 is installed in the inlet port 112.
Figure 11A:
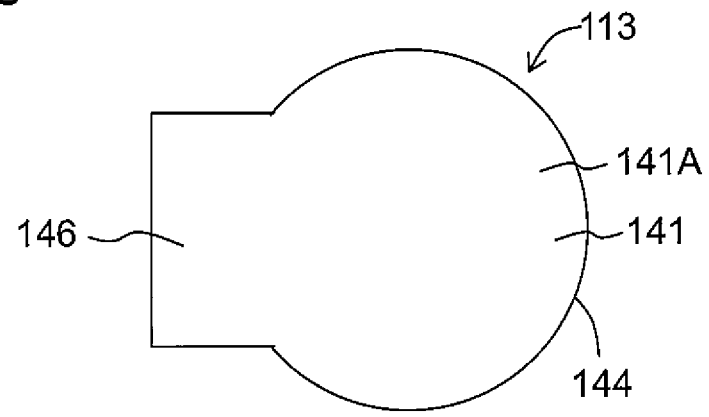
Figure 11B:
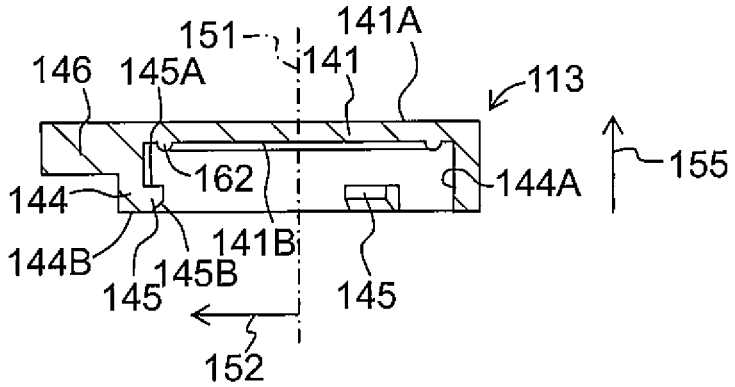
Figure 11C:
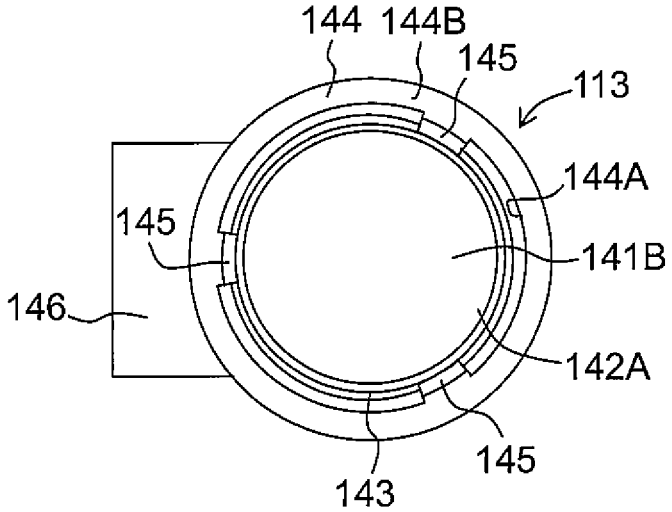

In this configuration, a seal portion 162 is arranged to project in the direction opposite to the first direction 155 from the back surface 141B of the lid portion 141, as depicted in FIGS. 9A, 9B and FIG. 11B. The seal portion 162 has a ring shape. The central axis of the ring shape in the seal portion 162 is coincident with the central axis line 151.

Figure 10A:
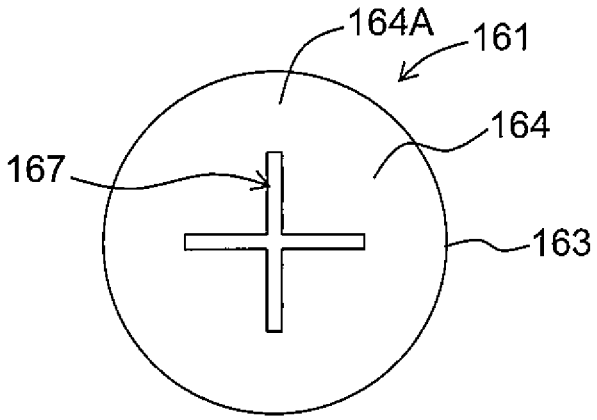
Figure 10B:
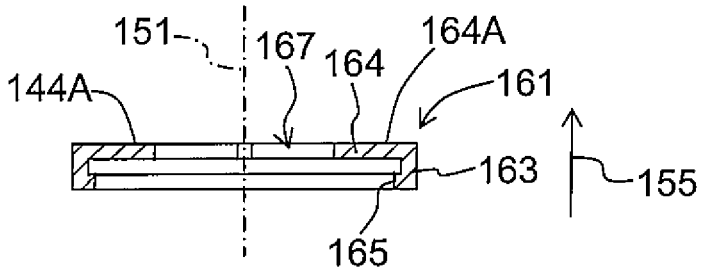
Figure 10C:
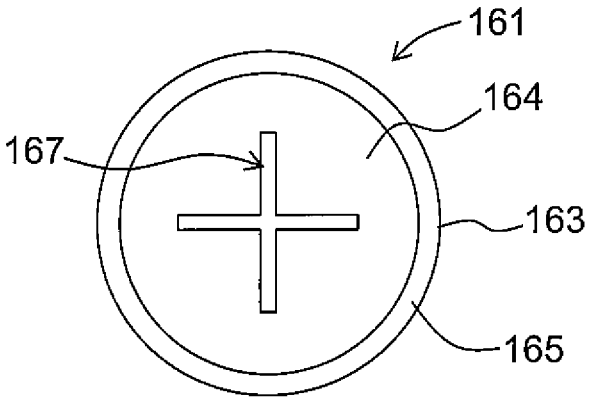

As depicted in FIGS. 10A to 10C, the inner lid 161 is provided with a peripheral portion 163, an extending portion 164 and a projecting portion 165. The inner lid 161 is formed of an elastic material such as a rubber, elastomer, etc., having a low modulus of elasticity. Since the inner lid 161 is formed of the elastic material having the low modulus of elasticity, the inner lid 161 is thereby easily deformed when the ink is supplied to the ink tank 100 via a cylindrical wall 171, and is resorted to have the original shape after being deformed.

The peripheral portion 163 has a cylindrical shape with the central axis line 151 as the center thereof. The inner diameter of the peripheral portion 163 is substantially same as the outer diameter of an end portion 172 of the cylindrical wall 171. The outer diameter of the peripheral portion 163 is substantially same as the outer diameter of a first portion 174 of the cylindrical wall 171.

The extending portion 164 is extended, along a plane orthogonal to the central axis line 151, from an end edge portion of the peripheral portion 163 toward the central axis line 151. The extending portion 164 is formed with a cross-shaped opening 167 of which point of intersection is the central axis line 151.

The projecting portion 165 is projecting toward the central axis line 151 from an end edge portion, of the peripheral portion 163, facing the direction opposite to the first direction 155. The inner diameter of the projecting portion 165 is substantially same as the outer diameter of an inner lid-engaging portion 173 of the cylindrical wall 173.

As depicted in FIGS. 9A and 9B, the cylindrical wall 171 in the third modification is provided with the end portion 172, the inner lid-engaging portion 173, the first portion 174 and a second portion 175.

Each of the end portion 172, the inner lid-engaging portion 173, the first portion 174 and the second portion 175 has a cylindrical shape. The end portion 172, the inner lid-engaging portion 173, the first portion 174 and the second portion 175 are integrally formed in a state that the second portion 175, the first portion 174, the inner lid-engaging portion 173 and the end portion 172 are stacked on the peripheral edge portion of an opening 101E of the inclined surface 101 in this order, from the side closer to the inclined wall 101B, with the central axes of the respective cylindrical shapes thereof being made to be coincident or matched with one another. A line passing through the central axes of the end portion 172, the inner lid-engaging portion 173, the first portion 174 and the second portion 175 is the central axis line 151. The inner circumferential surfaces of the end portion 172, the inner lid-engaging portion 173, the first portion 174 and the second portion 175 and the opening 101E, respectively, are (define) are an inner circumferential surface 171A defining the inlet port 112. The inner circumferential surfaces of the end portion 172, the inner lid-engaging portion 173, the first portion 174, the second portion 175 and the opening 101E of the inclined wall 101B, respectively, have a same inner diameter, and are located on one virtual cylindrical surface. The central axis line 171 of the cylindrical wall 151 is also the central axis line 151 of the inlet port 112.

The outer diameter of the inner lid-engaging portion 173 is smaller than the outer diameter of the end portion 172. The outer diameter of the first portion 174 is greater than the outer diameter of the end portion 172 and the outer diameter of the inner lid-engaging portion 173. The outer diameter of the second portion 175 is smaller than the outer diameter of the first portion 174. The outer circumferential surface of the end portion 172 and the outer circumferential surface of the inner lid-engaging portion 173 are connected to each other by a first connecting surface 176. The first connecting surface 176 is extended along the plane orthogonal to the central axis line 151. The outer circumferential surface of the first portion 174 and the outer circumferential surface of the second portion 175 are connected to each other by a second connecting surface 177. The second connecting surface 177 is extended along the plane orthogonal to the central axis line 151. Accordingly, the outer circumferential surface of the inner lid-engaging portion 173 has a shape recessed toward the central axis line 151, with respect to the outer circumferential surface of the end portion 172; the outer circumferential surface of the second portion 175 has a shape recessed toward the central axis line 151, with respect to the outer circumferential surface of the first portion 174.

As depicted in FIG. 9B, the inner lid 161 is attached to an end portion, in the cylindrical wall 171, facing the first direction 155 so that the central axis of the inner lid 161 and the central axis of the cylindrical wall 171 are coincident with each other. The central axis line 151 of the cylindrical wall 171 is also the central axis line 151 of the inner lid 161. In a state that the inner lid 161 is attached to the cylindrical wall 171, the projecting portion 165 of the inner lid 161 is engaged with the inner lid-engaging portion 173 of the cylindrical wall 171. Since the inner diameter of the projecting portion 165 is substantially same as the outer diameter of the inner lid-engaging portion 165, the inner lid 161 is fixed to the cylindrical wall 171. The end portion 172 of the cylindrical wall 171 is sandwiched between the extending portion 164 and the projecting portion 165 of the inner lid 161. The inner circumferential surface of the peripheral portion 163 of the inner lid 161 abuts against (contacts) the outer circumferential surface of the end portion 172, and the inner circumferential surface of the projecting portion 165 abuts against (contacts) the outer circumferential surface of the inner lid-engaging portion 173, thereby allowing the central axis line 151 of the inner lid 161 and the central axis line 151 of the cylindrical wall 171 to be coincident with each other. Since the outer circumferential surface of the inner lid 161 and the outer circumferential surface of the first portion 174 have a same diameter, the outer circumferential surface of the inner lid 161 and the outer circumferential surface of the first portion 174 thus are located on one virtual cylindrical surface. The extending portion 164 of the inner lid 161 covers the opening defined by the end portion 172, of the cylindrical wall 171, in the first direction 155. The inner lid 161 is generally used without being detached from the cylindrical wall 171.

In a case of attaching the cap 113 to the inlet port 112, the user presses the cap 113 toward the inlet port 112 such that the cylindrical wall 171 is inserted into the inside of the connecting portion 144 of the cap 113. In this situation, the end edge portion of the peripheral portion 163, of the inner lid 161, which is located to be above in the first direction 155 relative to the end surface 171B of the cylindrical wall 171 abuts against the guide surface 145B of each of the stoppers 145 while a force moving the cap 113 in the direction opposite to the first direction 155 is applied to the cap 113. With this, the connecting portion 144 is elastically deformed such that the diameter of the connecting portion 144 is expanded or increased to thereby move the stoppers 145 to the outside of the radial directions of the cylindrical wall 171 and the inlet port 112. As result, the diameter of the virtual cylindrical surface defined by the end surfaces of the three stoppers 145 is expanded or increased. When the cap 113 is attached to the inlet port 112, whether or not the center of the holding portion 146 and the center of a certain stopper 145, among the three stoppers 145, which is located closely to the holding portion 146 are arranged side by side to each other in the radial directions of the cylindrical wall 171 and the inlet port 112 provided that the cap 113 is seen from the first direction 155 does not particularly affect the action of attachment of the cap 113 to the inlet port 112.

In a case that the cap 113 is continuously pressed into the inlet port 112, the stoppers 145 pass the first portion 174, of the cylindrical wall 171, of which outer diameter is greater than the diameter of the virtual cylindrical surface defined by end surfaces of the respective stoppers 145, and achieves an installed state as depicted in FIG. 9B. In the installed state, each of the stoppers 145 is located at a position at which the stopper 145 is adjacent, in the radial direction of the cylindrical wall 171, to the second portion 175, of the cylindrical wall 171, of which outer diameter is smaller than the diameter of the virtual cylindrical surface defined by the end surfaces of the respective stoppers 145. With this, each of the stoppers 145 is in a state that the force elastically deforming the connecting portion 144 toward the outside of the radial directions of the cylindrical wall 171 and the inlet port 112, which has been applied to the stoppers 145 by the first portion 174 of the cylindrical wall 171, is not applied to the stoppers 145. As a result, the elastic deformation of the connecting portion 144 is returned to the original shape of the connecting portion 144. In the installed state, the abutting surfaces 145A of the respective stoppers 145 face and abut against the second connecting surface 177 of the cylindrical wall 171, in the first direction 155. With this, the stoppers 145 are engaged with the second portion 175, thereby fixing the cap 113 to the cylindrical wall 171. In the installed state, the seal portion 162 abuts against the surface of the extending portion 164 of the inner lid 161. In the state that the stoppers 145 are engaged with the second portion 175, the position of the end portion, of the seal portion 162, facing opposite to the first direction 155 is located to on the opposite side with respect to the first direction 155 (located to be below in the direction opposite to the first direction 155) relative to the surface 164A of the extending portion 164 of the inner lid 161. Therefore, a portion, in the extending portion 164, against which the seal portion 162 abuts is elastically deformed. In the state that the cap 113 is installed in the inlet port 112, the seal portion 162 makes a pressurized contact with the surface of the inner lid 161 which is located to be above in the first direction 155 relative to the end surface 117B of the cylindrical surface 171, thereby sealing the inlet port 112 in the liquid-tight manner. Namely, provided that the extending portion 164 of the inner lid 161 is considered as the end surface 171B of the cylindrical wall 171, then the seal portion 162 can be considered as elastically deforming the end surface 171B of the cylindrical wall 171 while contacting the end surface 171B, of the cylindrical wall 171, elastically deformed by the seal portion 162.

In a case of removing (detaching) the cap 113 from the inlet port 112, the user lifts (raises) the holding portion 146 of the cap 113 in the first direction 155 and the direction toward the central axis line 151. In this situation, a portion, of the connecting portion 144, connected to the holding portion 146 is elastically deformed in the direction separating away from the cylindrical wall 171. Then, the certain stopper 145, among the three stoppers 145, which is arranged side by side with the holding portion 146 in the radial directions of the cylindrical wall 171 and the inlet port 112, under the condition that the cap 113 is seen from the first direction 155, is moved to a position outside of the radial direction. As a result, the certain stopper 145 is moved to a position at which the abutting surface 145A of the certain stopper 145 and the second connecting surface 177 do not face each other in the first direction 155. In a case that the abutting surface 145A of the one (certain) stopper 145 does not face the second connecting surface 177 in the first direction 155, the holding portion 146 is then moved in the first direction 155 and the direction toward the central axis line 151, thereby moving also the abutting surfaces 145A of the remaining stoppers 145 among the three stoppers 145 to positions at which the abutting surfaces 145A of the remaining stoppers 145 do not face the second connecting surface 177. As a result, the cap 113 is removed (detached) from the inlet port 112.

Since the inner lid 161 covering the end surface 171B of the cylindrical wall 171 is elastically deformed to contact the seal portion 162, the space between the cap 113 and the cylindrical wall 171 is sealed in the liquid-tight manner.

Further, in a case that any inner lid is not provided in this configuration, the space between the cap 113 and the cylindrical wall 171 can be sealed in the liquid-tight manner by allowing the seal portion 162 to be elastically deformed to make contact with the end surface 171B of the cylindrical wall 171.

<Forth Modification>

Figure 12A:
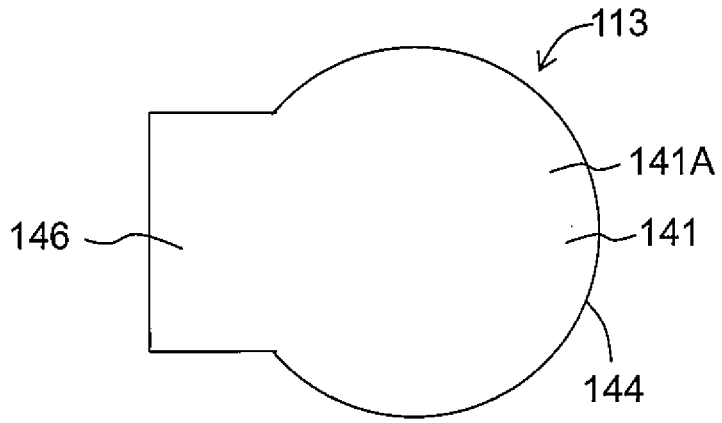
Figure 12B:
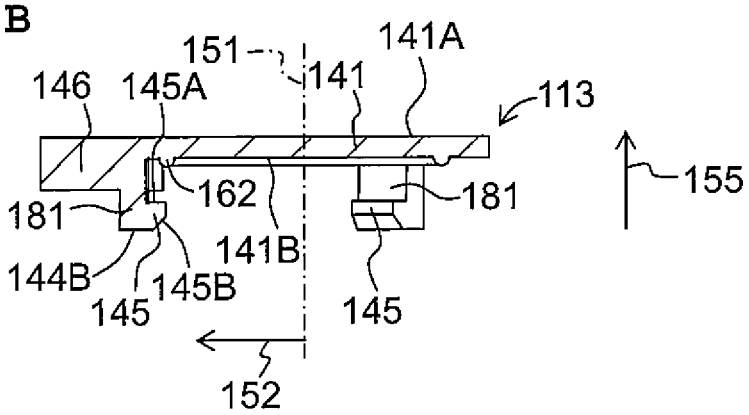
Figure 12C:
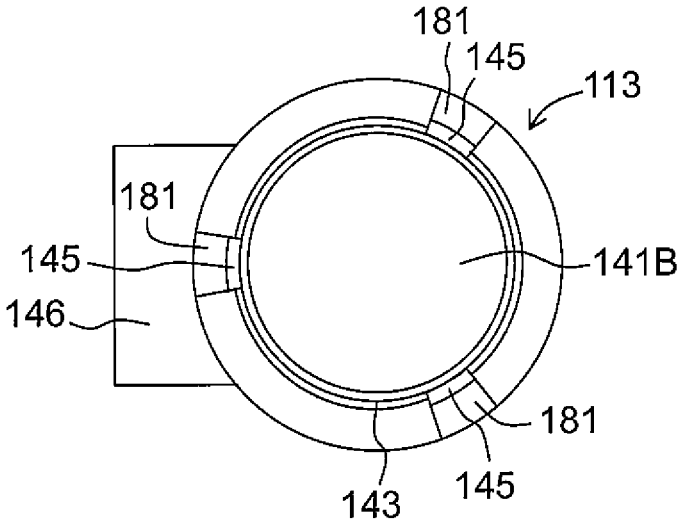

In the above-described embodiment and first to third modifications, the connecting portion 144 of the cap 113 has the cylindrical shape. As depicted in FIGS. 12A to 12C, however, it is allowable to use three connecting portions 181 which are formed non-continuous manner in the circumferential direction. In this configuration, each of the connecting portions 181 has a flat plate-like shape extending from the back surface 141B of the lid portion 141 in the direction opposite to the first direction 155, at a position at which one of the stoppers 145 is located in the radiation direction with the first direction 155 as the center, and connects the stopper 145 and the lid portion 141.

With this, the connecting portions 181 are elastically deformed more easily, thereby making it possible to remove the cap 113 more easily.

<Fifth Modification>

Figure 13A:
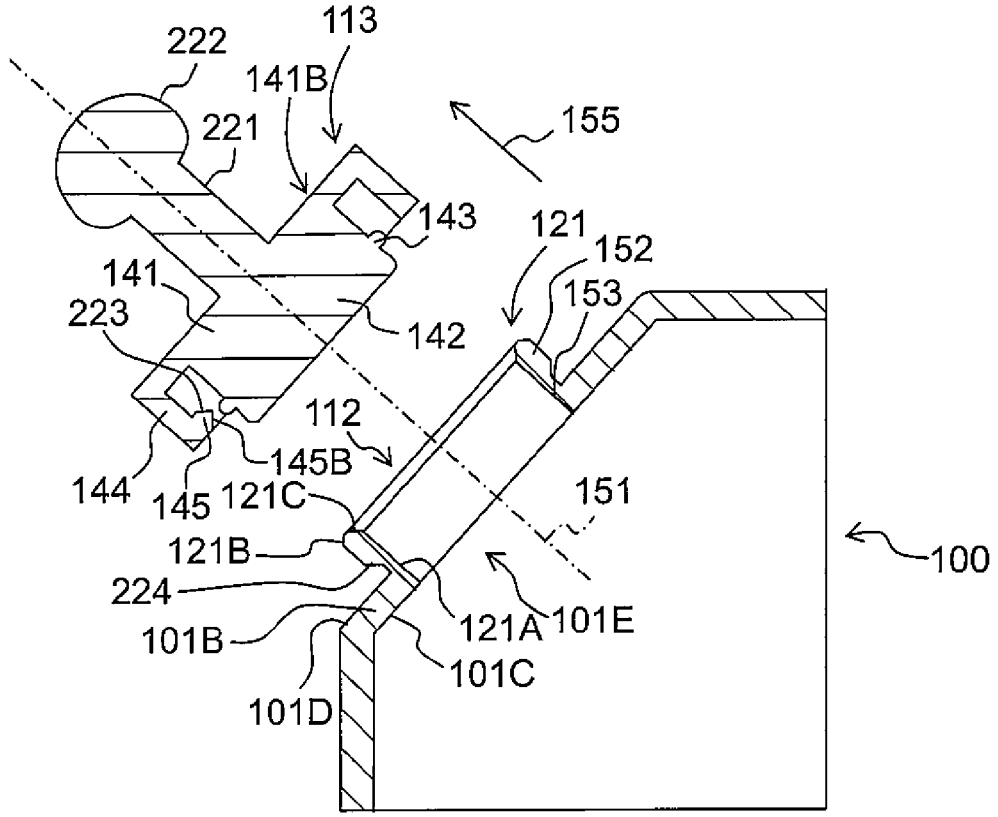
Figure 13B:
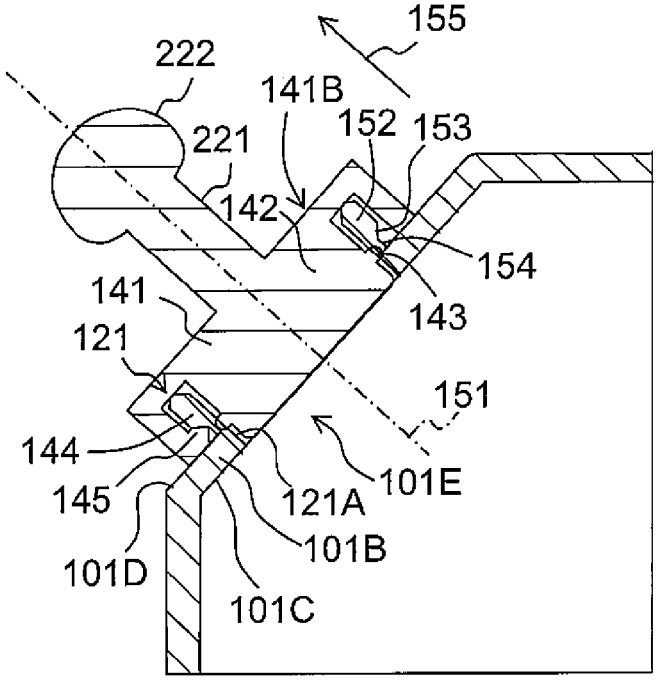

In the above-described embodiment and first to fourth modifications, the abutting surface 145A of the stopper 145 is extended along the plane orthogonal to the central axis line 151. Further, the connecting surfaces 154 and 177 of the cylindrical walls 121 and 171, respectively, are extended along the plane orthogonal to the central axis line 151. It is allowable, however, that each of the stoppers 145 has an abutting surface 223 which is inclined with respect to the first direction 155 so as to be away farther from the lid portion 141 as separating farther from the connecting portion 144, as depicted in FIGS. 13A and 13B. In conformity with this configuration, it is allowable that the cylindrical wall 121 has a connecting surface 224 which is inclined with respect to the first direction 155 so as to be away farther from the inclined wall 101B as separating farther from the second portion 153, as depicted in FIGS. 13A and 13B.

Figure 14A:
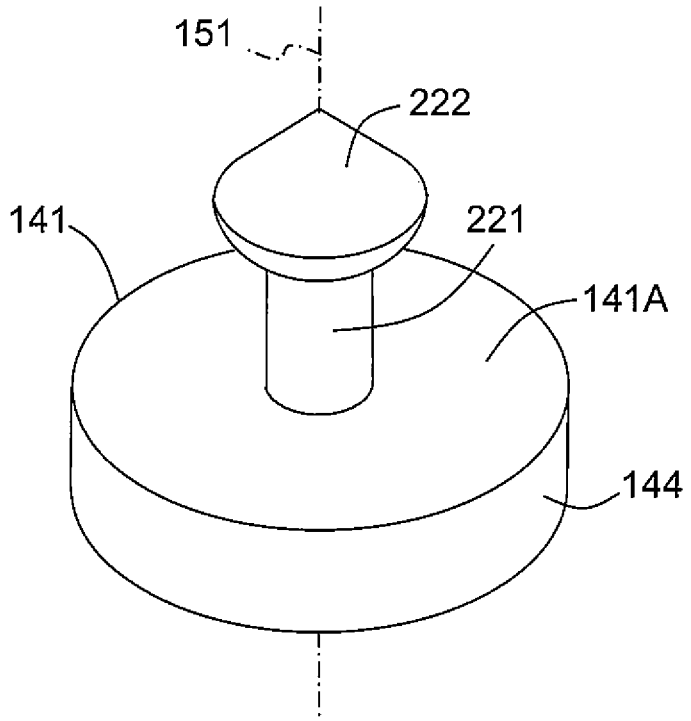

Such shapes of the abutting surface 223 and of the connecting surface 224 are particularly preferable in a case that a holding portion 221 has a shape projecting from the surface 141A of the lid portion 141 in the first direction 155 along the central axis line 151, as depicted in FIGS. 13A and 13B and FIG. 14A. The holding portion 221 has a columnar shape of which central axis is coincident with the central axis line 151. The holding portion 221 may be provided with a stopping portion 222 having a spherical shape, at an end portion of the holding portion 221 facing the first direction 155. The diameter of the stopping portion 222 is greater than the outer diameter of the holding portion 221. The stopping portion 222 functions as a slip-preventing member when the user pulls the holding portion 221 in the first direction 155. The arrangement of such a holding portion 221 is suitable in a case that the user pulls, in the state that the cap 113 is installed in the inlet port 112, the holding portion 221 in the first direction 155 to thereby pull the cap 114 out from the inlet port 112. In the fifth modification, the engagement force between the abutting surface 223 and the connecting surface 224 in the case that the cap 113 is pulled in the first direction 155 is weaker than the engagement force between the abutting surface 145A and the connecting surface 154 in the above-described embodiment and the first to fourth modifications in the case that the cap 113 is pulled in the first direction 155. Accordingly, the user pulls the holding portion 221 in the first direction 155, without pulling, for example, the holding portion 221 in a direction crossing or intersecting the central axis line 151, thereby making it possible to easily release the contact between the abutting surfaces 223 of the three stoppers 145 and the connecting surface 224, which in turn allows the cap 113 to be easily removed from the cylindrical wall 121.

Figure 14B:
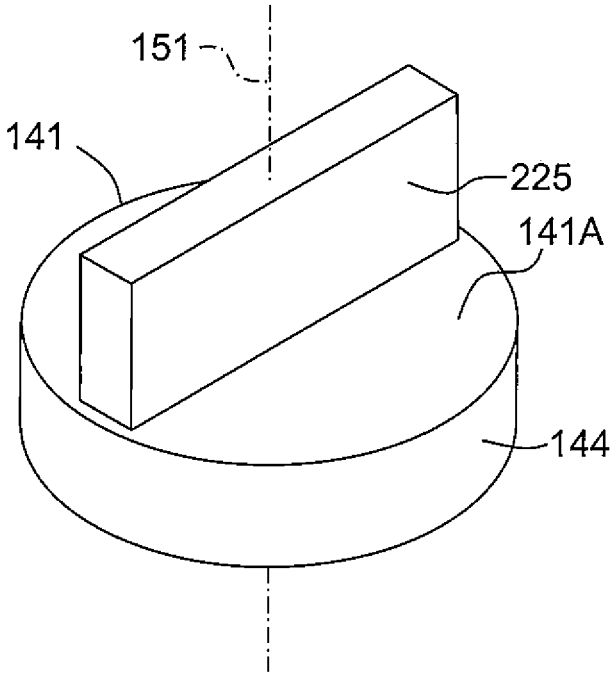

In a case that the abutting surface 223 and the connecting surface 224 in the fifth modification are adopted, it is allowable that the cap 113 has a holding portion 225 projecting from the surface 141A of the lid portion 141 in the first direction 155, and having a flat plate-like shape including a plane orthogonal to the central axis line 151 and a plane parallel to the central axis line 151, as depicted in FIG. 14B. Also with this configuration, it is possible to obtain the effect similar to that obtained by the case provided with the holding portion 221.

<Second Embodiment>

It is allowable that an inlet port 192 and a cap 191 have the configurations as depicted in FIGS. 15A to 15C and FIGS. 16A to 16C, respectively. The cap 191 depicted in FIGS. 16A to 16C can be attached to and detached from the inlet port 192 depicted in FIGS. 15A to 15C.

Figure 15A:
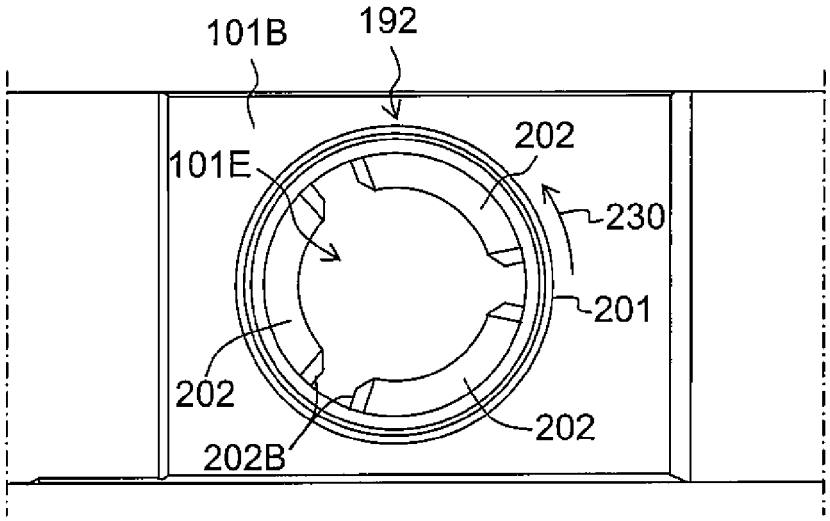
Figure 15B:
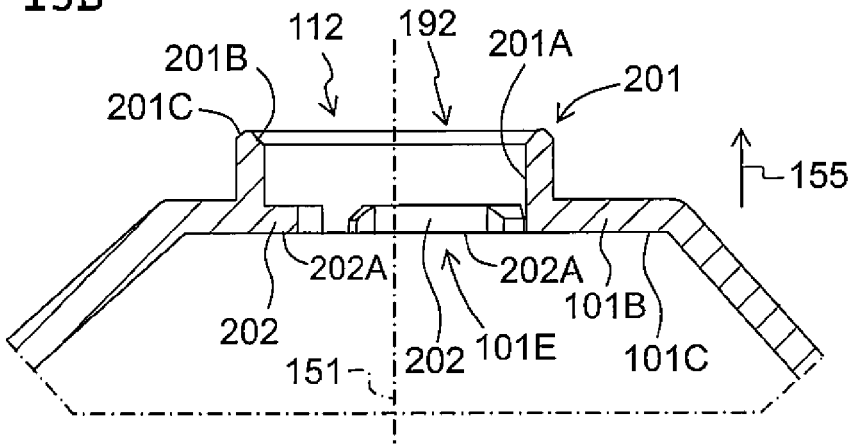
Figure 15C:
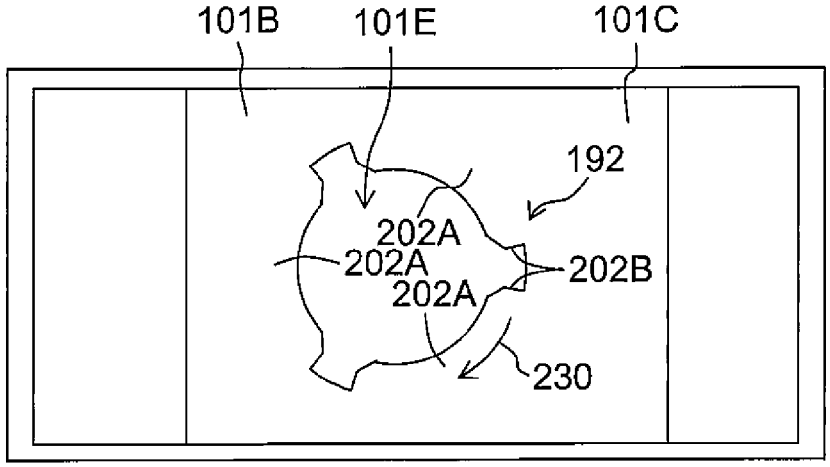

As depicted in FIGS. 15A to 15C, the inlet port 192 is provided with a cylindrical wall 201 and three engaging portions 202.

The cylindrical wall 201 has a cylindrical shape of which center is the central axis line 151. The cylindrical wall 201 is extended in the first direction 155 from the periphery of an opening 101E provided on the inclined wall 101B of the ink tank 100. An end surface, of the cylindrical wall 201, facing the first direction 155 forms an inner guide surface 201B which is inclined with respect to the central axis line 151 (first direction 155) so as to approach more closely to the inclined wall 101B wall as separating farther from the central axis line 151, and an outer guide surface 201C which is inclined with respect to the first direction 155 so as to approach more closely to the inclined surface 101B as separating farther from the central axis line 151.

Each of the three engaging portions 202 is a projection extending toward the central axis line 151 from the inner circumferential surface, of the inclined wall 101B, defining the opening 101E as a portion of the inlet port 192 provided on the inclined wall 101B of the ink tank 100. The three engaging portions 202 has a same shape. End surfaces (surfaces most closely to the central axis line 151) of the three engaging portions 202 are located on a virtual cylindrical surface defined by the end surfaces of the three engaging portions 202. The three engaging portions 202 are positioned with a spacing distance (gap) therebetween (while being spaced from one another), in the circumferential direction of the inclined wall 101B, namely in the circumferential direction of which center is the first direction 155 and the central axis line 151. The three engaging portions 202 are arranged in the circumferential direction at equal intervals therebetween. Namely, a orthogonal line extending toward the central axis line 151 from the center of a certain engaging portion 202 among the three engaging portions 202 defines an angle of 120 degrees with each of orthogonal lines extending toward the central axis line 151 respectively from the centers of other engaging portions 202 among the three engaging portions 202. Both end portions, in each of the engaging portions 202, in the circumferential direction are formed with inclined surfaces each of which is inclined with respect to the first direction 155 so as to approach more closely to the inside of the ink tank 100 as separating farther from the center, of the engaging portion 202, in the circumferential direction. An end portion, in the circumferential direction of an end surface, of each of the three engaging portions 202 is an inclined surface inclined with respect to the first direction 155 so as to approach more closely to the inner circumferential surface of the cylindrical wall 201, as separating farther from the center, of the engaging portions 202, in the circumferential direction. The engaging portions 202 are an example of a "projection".

Figure 16A:
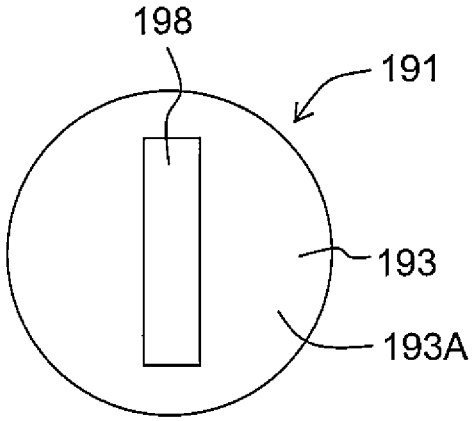
Figure 16B:
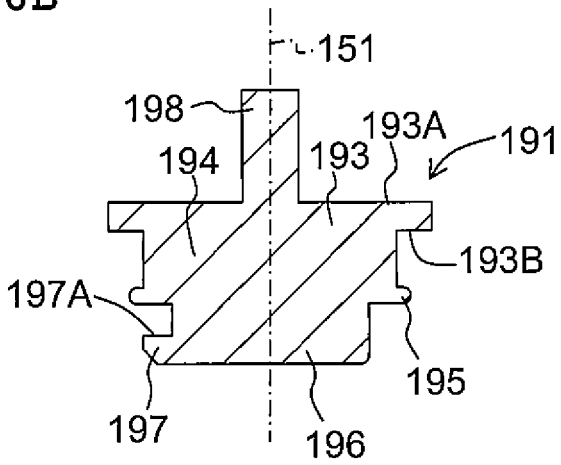
Figure 16C:
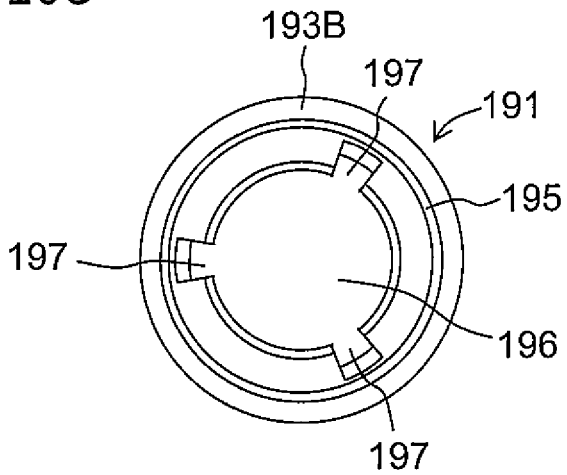

As depicted in FIGS. 16A to 16C, the cap 191 is provided with a lid portion 193, an insertion portion 194, a seal portion 195, a connecting portion 196, three stoppers 197 and a holding portion 198. The cap 191 is formed of a synthetic resin such as polypropylene (PP), polyethylene (PE), or of an elastic material such as rubber, elastomer, etc.

The lid portion 193 has a disc-shape with the central axis line 151 as the center thereof. The outer diameter of the lid portion 193 is greater than the outer diameter of the cylindrical wall 201. A surface, of the lid portion 193, facing the first direction 155 is defined as a front surface 193A, and a surface, of the lid portion 193, facing a direction opposite to the first direction 155 is defined as a back surface 193B.

The holding portion 198 is projecting from the front surface 193A of the lid portion 193 in the first direction 155 and has a rectangular plate-like shape including a plane and orthogonal to the central axis line 151 and a plane parallel to the central axis line 151.

The insertion portion 194 is projecting from a central portion of the back surface 193B of the lid portion 193, in the direction opposite to the first direction 155. The insertion portion 194 has a columnar shape. The central axis in the columnar shape of the insertion portion 194 is coincident with the central axis line 151. The outer diameter of the insertion portion 194 is smaller than the outer diameter of the lid portion 193. Further, the outer diameter of the insertion portion 194 is smaller than the inner diameter of the inlet port 192.

The seal portion 195 is projecting outwardly from an end portion, in the outer circumferential surface of the insertion portion 194, facing the direction opposite to the first direction 155; the seal portion 195 is formed to have a ring shape surrounding the outer circumferential surface of the insertion portion 194, with the central axis line 151 as the center of the seal portion 195. The outer diameter of the seal portion 195 is greater than the inner diameters of the inlet port 192.

The connecting portion 196 is projecting in the direction opposite to the first direction 155 from an end surface, in the insertion portion 194, facing opposite to the first direction 155. The connecting portion 196 has a columnar shape. The central axis in the columnar shape of the connecting portion 196 is coincident with the central axis line 151. The outer diameter of the connecting portion 196 is smaller than the outer diameter of the insertion portion 194. Further, the outer diameter of the connecting portion 196 is smaller than the diameter of a virtual cylindrical surface, defined by end surfaces of the respective engaging portions 202 of the cylindrical wall 201.

The three stoppers 197 are projecting outwardly from an end edge portion, of the outer circumferential surface of the connecting portion 196, facing opposite to the first direction 155. The three stoppers 197 has a same shape. The three stoppers 197 are arranged in the circumferential direction of the outer circumferential surface of the connecting portion 196, namely, in the circumferential direction of which center is the first direction 155 and the central axis lines 151, at equal intervals therebetween in the circumferential direction. Namely, an orthogonal line extending toward the central axis line 151 from the center of a certain stopper 197 among the three stoppers 197 defines an angle of 120 degrees with each of orthogonal lines extending toward the central axis line 151 respectively from the centers of other stoppers 197 among the three stoppers 197. A side surface, in the stopper 197, facing the first direction 155 forms an abutting surface 197A having a plane orthogonal to the central axis line 151. A side surface, of the stopper 197, facing opposite to the first direction 155, forms a guide surface 197B which is inclined with respect to the central axis line 151 (first direction 155) so as to approach more closely to the back surface 193B of the lid portion 193 as separating farther from the central axis line 151. The diameter of a virtual cylindrical surface, defined by end surfaces of the respective stoppers 197 is smaller than the inner diameter of the inlet port 192, and is greater than the diameter of the virtual cylindrical surface, defined by end surfaces of the respective engaging portions 202 of the inlet port 192. Further, the size (dimension) of the stopper 197 along the circumferential direction along the circumferential direction is smaller than the size (dimension) of the interval along the circumferential direction between side end edge portions 202B of adjacent engaging portions 202 which are included in the three engaging portions 202 and which are adjacent in the circumferential direction.

In a case of attaching the cap 191 to the inlet port 192, the user presses the cap 191 toward the inlet port 192 such that the insertion portion 194 is inserted inside the inlet port 192. When the cap 191 is pressed into the inlet port 192, the seal portion 195 is abutted against the inner circumferential surface 201A of the cylindrical wall 201, and thus the seal portion 195 is elastically deformed such that the outer diameter of the seal portion 195 is reduced. With this, the outer circumferential surface of the seal portion 195 is brought into pressurized contact with the inner circumferential surface 201A of the cylindrical wall 201, thereby allowing the seal portion 195 to seal the inlet port 192 in the liquid-tight manner.

In a case that the cap 191 is continuously pressed into the inlet port 192, the stoppers 197 abut against the engaging portions 202, respectively. In this state, when the cap 191 is rotated about the central axis line 151 to allow the cap 119 to have a state in which the stoppers 197 do not abut against the engaging portions 202, respectively, namely a state in which each of the stoppers 197 is located, in the circumferential direction with the first direction 155 as the center thereof, between the side end edge portions 202B of two engaging portions 202, which are included in the three engaging portions 202 and which are adjacent in the circumferential direction provided that the cap 119 is seen from the first direction 155. The cap 191 is further pressed to thereby allow the back surface 193B of the lid portion 193 to abut against the end surface facing the first direction 155 of the cylindrical wall 201. In this state, the cap 191 is rotated again about the central axis line 151, thereby allowing each of the engaging portions 202 to face one of the stoppers 197 in the first direction 155. It is allowable that the engaging portions 202 abut against the stoppers 197 or does not abut against the stoppers 197, respectively. With this, the cap 191 is installed in the inlet port 192. In the state that the insertion portion 194 is installed in the inlet port 192, the seal portion 195 seals the inlet port 192 in the liquid-tight manner.

In a case of removing the cap 191 from the inlet port 192, the user holds (grabs) the holding portion 198 and pulls the cap 191 in the first direction 155. This allows the abutting surface 197A of each of the stoppers 197 abuts against the inner surface 202A of one of the engaging portions 202. In this state, the user rotates the cap 191 about the central axis line 151, thereby providing a state in which the engaging portions 202 do not face the stoppers 197, respectively, in the first direction 155. By pulling the cap 191 out in the first direction 155 in this state, the cap 191 is removed from the inlet port 192.

Since the stopper 197 is provided as the three stoppers 197 arranged while being spaced from each other in the circumferential direction, the cap 191 can be rotated about the central axis line 151 to thereby allow the cap 191 to move up to a position at which the abutting surfaces 197A of the three stoppers 197 can abut against the three engaging portions 202, respectively, without elastically deforming the cap 191 (stoppers 197), thereby allowing the cap 191 to be installed in the inlet port 192. Similarly, by rotating the cap 191 about the central axis line 151, it is possible to release the contact of the abutting surfaces 197A of the three stoppers 197 with respect to the three engaging portions 202, without deforming the cap 191, thereby allowing the cap 191 to be removed from the inlet port 192.

<Sixth Modification>

In the above-described second embodiment, the engaging portions 202 may be provided with stopper portions, respectively, in order to stop the rotation of the cap 191 at a position at which each of the engaging portions 202 and one of the stoppers 197 do not face each other in the first direction 155. For example, the stopper portions are provided so as to project, in the first direction 155 and in the direction opposite to the first direction 155, from the side end edge portions 202B in a first rotational direction 230 in the circumferential direction of the respective engaging portions 202. The stopper portions each have a plane parallel to the central axis line 151.

In a case of attaching the cap 191 to the inlet port 192, the user presses the cap 191 toward the inlet port 192 until the stoppers 197 abut against the engaging portions 202, respectively, and then the user rotates the cap 191 in a direction opposite to the first rotational direction 230 about the central axis line 151 until the stoppers 197 abut against the stopper portions, respectively. With this, the stoppers 197 are located at positions at which each of the stoppers 197 does not face one of the engaging portions 202 in the first direction 155.

On the other hand, in a case of removing the cap 191 from the inlet port 192, in the state that the cap 191 is installed in the inlet port 192, the user rotates the cap 191 in the first rotational direction 230 about the central axis line 151 until the stoppers 197 abut against the stopper portions, respectively. With this, the stoppers 197 are located at positions at which each of the stoppers 197 faces one of the engaging portions 202 in the first direction 155.

<Third Embodiment>

Figure 17A:
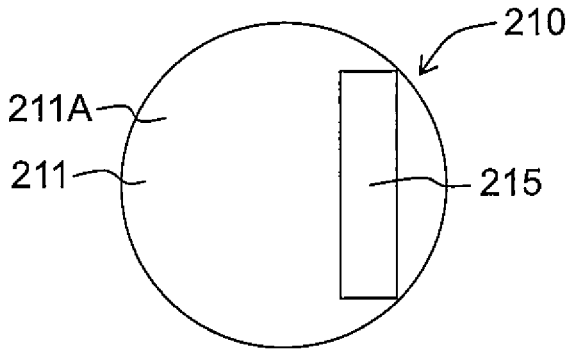
Figure 17B:
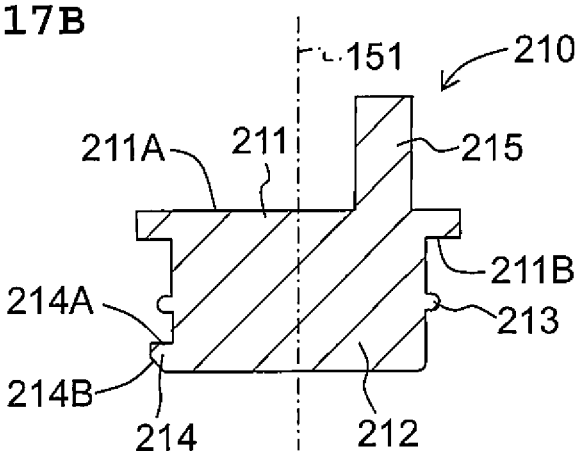
Figure 17C:
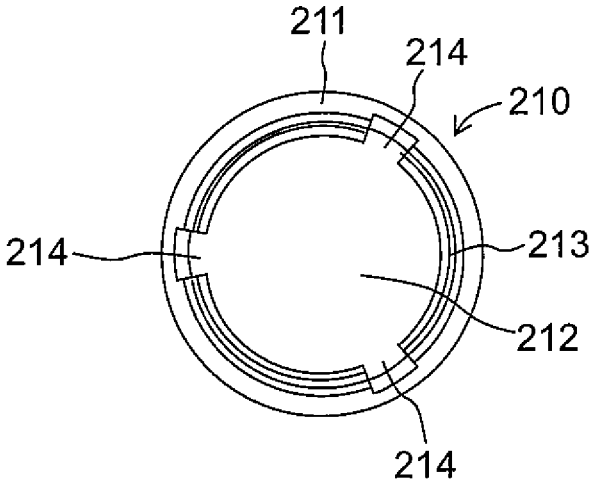

It is allowable to adopt a cap 210 depicted in FIGS. 17A to 17C, rather than the cap 113 depicted in FIGS. 7A to 7F. The cap 210 is attachable and detachable with respect to the inlet port 112 having the shape depicted in FIGS. 6A and 6B. The cap 210 is formed of an elastic material having a low modulus of elasticity such as rubber, elastomer, etc. Owing to the low modulus of elasticity possessed by the cap 210, stoppers 214 (as described below) are easily deformed.

The cap 210 is provided with a lid portion 211, an insertion portion 212, a seal portion 213, three stoppers 214 and a holding portion 215.

The lid portion 211 has a disc-shape with the central axis line 151 as the center thereof. The outer diameter of the lid portion 211 is greater than the outer diameter of the cylindrical wall 121. A surface, of the lid portion 211, facing the first direction 155 is defined as a front surface 211A, and a surface, of the lid portion 211, facing the direction opposite to the first direction 155 is defined as a back surface 211B.

The holding portion 215 has a rectangular plate-like shape. The holding portion 215 extends in the first direction 155 and expands from the surface 211A of the lid portion 211, in parallel to a plane including the central axis line 151, at a position not including the central axis line 151. The holding portion 211 is located in the vicinity of a peripheral portion of the lid portion 211.

The insertion portion 212 has a columnar shape. The insertion portion 212 is projecting from a central portion of the back surface 211B of the lid portion 211, in the direction opposite to the first direction 155. The central axis in the columnar shape of the insertion portion 212 is coincident with the central axis line 151. The outer diameter of the insertion portion 212 is smaller than the outer diameter of the lid portion 211. Further, the outer diameter of the insertion portion 212 is smaller than the inner diameters of the inlet port 211.

The seal portion 213 is projecting outwardly from an outer circumferential surface of the insertion portion 212, and is formed to have a ring shape having the central axis line 1551 as the center thereof, and surrounding the outer circumferential surface of the insertion portion 212. The outer diameter of the seal portion 213 is greater than the inner diameter of the inlet port 112.

The three stoppers 214 are projecting outwardly in the radial directions of the cylindrical wall 121 and of the inlet port 121, from an end edge portion, of the outer circumferential surface of the insertion portion 212, facing opposite to the first direction 155. The three stoppers 197 are arranged in the circumferential direction of the outer circumferential surface of the insertion portion 212, namely, in the circumferential direction of which center is the first direction 155 and the central axis line 151, while being spaced from each other. The three stoppers 214 are arranged at equal intervals therebetween in the circumferential direction. Namely, an orthogonal line extending toward the central axis line 151 from the center of a certain stopper 214 among the three stoppers 214 defines an angle of 120 degrees with each of orthogonal lines extending toward the central axis line 151 respectively from the centers of other stoppers 214 among the three stoppers 214. The stoppers 214 each has a substantially flat plate-like shape expanding along a plane orthogonal to the central axis line 151. The three stoppers 214 have a same shape. A side surface, in each of the stoppers 214, facing the first direction 155 forms an abutting surface 214A having a plane orthogonal to the central axis line 151. A side surface, of the stopper 214, facing opposite to the first direction 155, forms a guide surface 214B which is inclined with respect to the central axis line 151 (first direction 155) so as to approach more closely to the lid portion 211 as separating farther from the central axis line 151. The diameter of a virtual cylindrical surface, defined by end surfaces of the respective stoppers 214 (surfaces of the stoppers located most closely to the central axis line 151) is greater than the diameter of the inlet port 112. In a case that the cap 210 is seen from the first direction 115, the center of one stopper 214, among the three stoppers 214, is positioned on the opposite side to the holding portion 215 with the central axis line 151 interposed therebetween. The center of the one stopper 214, the center of the holding portion 215 and the central axis line 151 are located on one virtual plane.

The shape of the outer circumferential surface of the cylindrical wall 121 of the inlet port 112 in the third embodiment is not particularly limited, and the outer circumferential surface of the cylindrical wall 121 may have any shape.

In a case of attaching the cap 210 to the inlet port 112, the user presses the cap 210 toward the inlet port 112 such that the insertion portion 212 is inserted inside the inlet port 112. In this situation, the inner guide surface 121C of the cylindrical wall 121 abuts against (contacts) the guide surface 214B of each of the stoppers 214 while a force moving the cap 210 in the direction opposite to the first direction 155 is applied to the cap 210. With this, the stoppers 214 are elastically deformed to be compressed to the inside of the radial directions of the cylindrical wall 121 and the inlet port 112, and the insertion portion 212 and the seal portion 213 are elastically deformed such that the diameters of the insertion portion 212 and the seal portion 213 are compressed (reduced). As result, the diameter of the virtual cylindrical surface defined by the end surfaces of the three stoppers 214 is reduced or decreased.

In a case that the cap 210 is continuously pressed into the inlet port 112, the stoppers 214 pass through the inlet port 112, of which inner diameter is smaller than the outer diameter of the stoppers 214, and the cap 210 is allowed to be in an installed state. In the installed state, each of the stoppers 214 is located in the inside of the ink tank 100. With this, each of the stoppers 214 is in a state that the force elastically deforming the stoppers 214 toward the inside of the radial directions of the cylindrical wall 121 and the inlet port 112, which has been applied to each of the stoppers 214 by the inner circumferential surface 121A of the cylindrical wall 121 or of the inclined wall 101, is not applied to each of the stoppers 214. As a result, the elastic deformation of the stoppers 214 is returned to the original shape of the stoppers 214. In the installed state, the abutting surfaces 214A of the respective stoppers 214 face the inner surface 101C of the inclined wall 101B of the ink tank 100.

Further, in the state that the cap 210 is installed in the inlet port 112, the outer circumferential surface of the seal portion 213 is brought into pressurized contact with the inner circumferential surface 121A of the cylindrical wall 121 or of the inclined wall 101B, thereby allowing the seal portion 213 to seal the inlet port 112 in the liquid-tight manner.

In a case of removing the cap 210 from the inlet port 112, the user pulls the holding portion 215 up in the first direction 155 and in the direction toward the central axis line 151. Since the cap 210 is formed of an elastic body having a low modulus of elasticity, a force toward the central axis line 151 is applied to a portion, of the surface 211A, at which the holding portion 215 is located. With this, a portion of the insertion portion 212 located in the vicinity of the holding portion 215 is elastically deformed and is compressed in the direction toward the central axis line 151. This causes to define a gap between the insertion portion 212 and the inner circumferential surface 121A of the cylindrical wall 121 or of the inclined wall 101B. Further, a force in the opposite direction to the first direction 155 is applied to the abutting surfaces 214A, of two stoppers 214 included in the three stoppers 214 and located near to the holding portion 215. With this, the stoppers 214 are elastically deformed to be compressed into the inside of the radial directions of the cylindrical wall 121 and of the inlet port 112. As a result, the abutment between the stoppers 214 and the inner surface 101C of the inclined wall 101B is released. Then, the stoppers 214 enter into the inlet port 112, and the cap 210 is moved upward with the two stoppers near to the holding portion 215 as a leading portion of the upward movement. As a result, the cap 210 is removed from the inlet port 112.

As described above, since the cap 210 is formed of the elastic body having the low modulus of elasticity, the two stoppers 214 located close to the holding portion 215 can be easily released from the engagement with the inclined wall 101B.

<Seventh Modification>

The abutting surface 214A of each of the three stoppers 214 in the third embodiment may be a surface inclined with respect to the central axis line 151 so as to be away farther from the lid portion 211 as separating farther from the insertion portion 212. In conformity with this configuration, it is allowable that an area, in the inner surface 101C of the inclined wall 101B, which faces the abutting surfaces 214A of the stoppers 214, namely a portion included in in the inner surface 101C of the inclined wall 101B and located in the vicinity of the inner circumferential surface 121A, may be an inclined surface which is inclined with respect to the central axis line 151 so as to be away farther from the outer guide surface 121B of the cylindrical wall 121 as separating farther from the inner circumferential surface 121A.

In this case, the user can easily release the abutting surfaces 214A of the stoppers 214 from the contact with the inner surface 101C of the cylindrical wall 101B.

Further, in the configuration of the seventh modification, even when the cap 210 is pulled out in the first direction 155, the contact between the abutting surfaces 214A of the stoppers 214 and the inner surface 101C of the inclined wall 101B can be easily released. Accordingly, it is allowable to adopt the holding portion 221 or 225 having the configuration as depicted in FIG. 14A or FIG. 14B.

<Other Modifications>

In each of the embodiments as described above, the stoppers 145, 197, 214 are arranged in the circumferential direction, with the first direction 155 as the center thereof, at equal intervals therebetween in the circumferential direction. However, it is not necessarily indispensable that the stoppers 145, 197, 214 are arranged at equal intervals therebetween in the circumferential direction. Further, it is not necessarily indispensable that the number of the stoppers 145, 197, 214 is three.

In a case that the number of the stoppers 145, 197, 214 is great, the engaging force of the stoppers 145, 197, 214 with respect to the inlet port 112, 192 of the cap 113, 191, 210 becomes strong. It is allowable to select the number of the stoppers 145, 197, 214 based on the elasticity of a material forming the cap 113, 191, 210, while considering the strength of the engaging force of the stoppers 145, 197, 214 with respect to the inlet port 112, 192 of the cap 113, 191, 210 and the easiness of removing the stoppers 145, 197, 214 from the inlet port 112, 192 of the cap 113, 191, 210.

Furthermore, in the respective embodiments and modifications as described above, the seal portions 143, 162, 195, 213 have the modulus of elasticity which is lower than the modulus of elasticity of the inner circumferential surfaces 121A, 171A, 210A of the cylindrical walls 121, 171, 210 or of the inclined wall 101B, or which is lower than the modulus of elasticity of the end surface 171B of the cylindrical wall 171; and the seal portions 143, 162, 195, 213 are elastically deformed to thereby seal the space between the seal portions 143, 162, 195, 213 and the cylindrical walls 121, 171, 201 in the liquid-tight manner. It is allowable, however, that the inner circumferential surfaces 121A, 171A, 210A of the cylindrical walls 121, 171, 210 or of the inclined wall 101B, or the end surface 171B of the cylindrical wall 171, have the modulus of elasticity which is lower than the modulus of elasticity of the seal portions 143, 162, 195, 213; and that the inner circumferential surfaces 121A, 171A, 210A of the cylindrical walls 121, 171, 210 or of the inclined wall 101B, or the end surface 171B of the cylindrical wall 171, may be elastically deformed to thereby seal the space between the seal portions 143, 162, 195, 213 and the cylindrical walls 121, 171, 201 in the liquid-tight manner.

The respective embodiments and modifications as described above are each merely an example of the present teaching. It is needless to say that the above-described embodiments and modifications can be appropriately changed without departing from the spirit and/or gist of the present teaching. Further, it is also possible to appropriately combine the above-described embodiments and modifications, without departing from the spirit and/or gist of the present teaching.

What is claimed is:

1. A tank configured to store a liquid to be supplied to a liquid discharging section, the tank comprising:

a liquid storage chamber configured to store the liquid;

an outer wall having an inner surface facing the liquid storage chamber and an outer surface facing outside of the tank;

a cylindrical wall having a cylindrical shape and extending from the outer wall in a first direction;

an inlet port penetrating through the outer wall and the cylindrical wall in the first direction, and communicating the liquid storage chamber with the outside of the tank;

an outlet port penetrating through the outer wall and communicating the liquid storage chamber with the outside of the tank; and a cap configured to be detachably installable in the inlet port, the cap including:

a seal portion configured to contact an inner circumferential surface of the cylindrical wall defining the inlet port or an inner circumferential surface of the outer wall defining the inlet port, or contact an end surface of the cylindrical wall exposed to the outside of the tank, in a state that the cap is installed in the inlet port; and a plurality of stoppers provided on the cap while being spaced from each other in a circumferential direction, of the cap, of which center is the first direction in the state that the cap is installed in the inlet port, each of the plurality of stoppers having an abutting surface configured to contact the tank toward the first direction under a condition that the cap is being moved toward the first direction from the state of being installed in the inlet port.

2. The tank according to claim 1, wherein the seal portion contacts one of the inner circumferential surface of the cylindrical wall, the inner circumferential surface of the outer wall and the end surface of the cylindrical wall while the seal portion is elastically deforming.

3. The tank according to claim 1, wherein the seal portion elastically deforms one of the inner circumferential surface of the cylindrical wall, the inner circumferential surface of the outer wall and the end surface of the cylindrical wall while contacting one of the inner circumferential surface of the cylindrical wall, the inner circumferential surface of the outer wall and the end surface of the cylindrical wall elastically deformed by the seal portion.

4. The tank according to claim 1, wherein the plurality of stoppers are arranged in the circumferential direction at equal intervals therebetween.

5. The tank according to claim 1, wherein the plurality of stoppers are provided as three stoppers.

6. The tank according to claim 1, wherein the cylindrical wall includes: a first portion; a second portion located between the first portion and the outer wall and having an outer diameter smaller than that of the first portion; and a connecting surface connecting an outer circumferential surface of the first portion and an outer circumferential surface of the second portion;

the cap includes a lid portion configured to face the inlet port in the first direction in the state that the cap is installed in the inlet port, and a connecting portion connecting the lid portion and the plurality of stoppers; and the abutting surface of each of the plurality of stoppers faces the connecting surface of the cylindrical wall in the first direction in the state that the cap is installed in the inlet port.

7. The tank according to claim 6, wherein the cap includes an insertion portion located in the inlet port in the state that the cap is installed in the inlet port; and an end portion, of the insertion portion, facing a direction opposite to the first direction is located to be above in the first direction than an end portion, of the connecting portion, facing the direction opposite to the first direction in the state that the cap is installed in the inlet port.

8. The tank according to claim 6, wherein the connecting portion and the plurality of stoppers of the cap are formed of a synthetic resin of which modulus of elasticity is greater than that of a rubber;

the cap includes a holding portion projecting from one of the lid portion and the connecting portion; and under a condition that the cap in the state of being installed in the inlet port is seen in the first direction, the holding portion is arranged side by side with one stopper among the plurality of stoppers in a direction orthogonal to the first direction and the holding portion is configured to be operated so as to change a position of the holding portion with respect to the lid portion and to thereby elastically deform the connecting portion so as to cause the one stopper to be separated from the connecting surface of the cylindrical wall.

9. The tank according to claim 6, wherein the connecting portion and the plurality of stoppers of the cap are formed of a rubber;

the cap includes a holding portion projecting from one of the lid portion and the connecting portion; and under a condition that the cap in the state of being installed in the inlet port is seen in the first direction, the holding portion is not arranged side by side with any one of the plurality of stoppers in a direction orthogonal to the first direction and the holding portion is configured to be operated so as to change a position of the holding portion with respect to the lid portion and to thereby elastically deform the connecting portion.

10. The tank according to claim 6, wherein the abutting surface of each of the plurality of stoppers is an inclined surface inclined with respect to the first direction so as to be away farther from the lid portion as separating farther from the connecting portion; and the connecting surface of the cylindrical wall is an inclined surface inclined with respect to the first direction so as to be away farther from the outer wall as separating farther from the second portion.

11. The tank according to claim 10, wherein the lid portion includes a disc-like shape expanding in a direction orthogonal to the first direction in the state that the cap is installed in the inlet port;

the cap includes a holding portion projecting from the lid portion in the first direction; and the holding portion is projecting from the lid portion at a location including a center of the disc-like shape.

12. The tank according to claim 1, wherein the cap includes an insertion portion configured to be located in the inlet port in the state that the cap is installed in the inlet port; and the seal portion is projecting from an outer circumferential surface of the insertion portion, and includes a ring shape surrounding the outer circumferential surface.

13. The tank according to claim 12, wherein the insertion portion includes a cylindrical shape or columnar shape having a central axis along the first direction in the state that the cap is installed in the inlet port;

each of the plurality of the stoppers is a projection projecting from the outer circumferential surface of the insertion portion;

the tank includes a plurality of projections projecting from the inner circumferential surface of the cylindrical wall or of the outer wall; and the abutting surface of each of the plurality of stoppers faces one of the plurality of projections of the tank in the first direction in the state that the cap is installed in the inlet port.

14. The tank according to claim 1, wherein the cap includes an insertion portion having a cylindrical shape or columnar shape of which central axis is along the first direction in the state that the cap is installed in the inlet port;

each of the plurality of the stoppers is a projection projecting from an outer circumferential surface of the insertion portion; and the abutting surface of each of the plurality of stoppers faces the inner surface of the outer wall in the first direction in the state that the cap is installed in the inlet port.

15. The tank according to claim 1, wherein the tank includes an atmosphere communicating portion configured to communicate the liquid storage chamber with the outside of the tank, and a semipermeable membrane sealing the atmospheric communication portion.

* * * * *